US007110684B2

(12) United States Patent
Isobe et al.

(10) Patent No.: US 7,110,684 B2
(45) Date of Patent: Sep. 19, 2006

(54) CARTRIDGE FOR REPLENISHING DEVELOPER INCLUDING A MEMORY DEVICE AND A CONTROL SYSTEM FEATURING THE CARTRIDGE

(75) Inventors: Hironobu Isobe, Shizuoka (JP); Masahide Kinoshita, Shizuoka (JP); Koichi Hiroshima, Shizuoka (JP); Ryuichi Yoshizawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 232 days.

(21) Appl. No.: 10/323,777

(22) Filed: Dec. 20, 2002

(65) Prior Publication Data

US 2003/0123889 A1 Jul. 3, 2003

Related U.S. Application Data

(62) Division of application No. 09/887,041, filed on Jun. 25, 2001, now Pat. No. 6,704,521.

(30) Foreign Application Priority Data

Jun. 26, 2000 (JP) ..... 2000/191814

(51) Int. Cl.
*G03G 15/08* (2006.01)

(52) U.S. Cl. ..... 399/27
(58) Field of Classification Search ..... 399/24, 399/27, 258, 260
See application file for complete search history.

(56) References Cited

U.S. PATENT DOCUMENTS

| | | | | | |
|---|---|---|---|---|---|
| 5,512,988 | A | * | 4/1996 | Donaldson | 399/120 |
| 5,826,134 | A | * | 10/1998 | Hino et al. | 399/27 |
| 6,226,025 | B1 | | 5/2001 | Kim | 347/228 |
| 6,510,294 | B1 | * | 1/2003 | Hakamada | 399/58 |
| 6,690,896 | B1 | * | 2/2004 | Hanada et al. | 399/27 |
| 2001/0036368 | A1 | | 11/2001 | Curry et al. | 399/12 |

FOREIGN PATENT DOCUMENTS

| | | | |
|---|---|---|---|
| JP | 5-2334 | * | 1/1993 |
| JP | 8-15984 | * | 1/1996 |
| JP | 11-15248 | * | 1/1996 |
| JP | 8-36280 | | 2/1996 |
| JP | 2002268345 A | * | 9/2002 |
| JP | 2002341639 A | * | 11/2002 |

* cited by examiner

*Primary Examiner*—Quana Grainger
(74) *Attorney, Agent, or Firm*—Fitzpatrick, Cella, Harper & Scinto

(57) ABSTRACT

Using two or more developer replenishing units, each of which has a first storage for storing identification information related to developer and a second storage for storing history information related to the developer, if the identification information read out from each developing replenishing unit accords with unique information stored in an image forming main body, the history information is read out from the developing replenishing unit and analyzed to judge whether the utilization amount of the developing replenishing unit is at the end of its life. If the developing replenishing unit is not at the end of its life, the discharge amount of the developer replenished from the developer replenishing unit is controlled according to the history information and image output results formed by means of the image forming main body.

16 Claims, 19 Drawing Sheets

CARTRIDGE FOR REPLENISHING DEVELOPER INCLUDING A MEMORY DEVICE AND A CONTROL SYSTEM FEATURING THE CARTRIDGE

CROSS-REFERENCE TO RELATED APPLICATION

This application is a divisional of application Ser. No. 09/887,041, filed Jun. 25, 2001, now U.S. Pat. No. 6,704, 521.

BACKGROUND OF THE INVENTION

1. Field of the Invention

The present invention relates to an image forming apparatus capable of forming images by using a toner replenishing unit for supplying toner to either or both of a process cartridge and a developing cartridge in the image forming apparatus such as an electrophotographic copying machine or an electrophotographic printer.

2. Related Background Art

Conventional electrophotographic image forming apparatuses have been adopting a process cartridge system in which a photosensitive body, charging or electrifying means, developing means, cleaning means, a toner container unit and the like are integrated into a cartridge. In this system, the cartridge is removably attached in the main body of the image forming apparatus concerned.

Such a cartridge system makes operation easier, and enables users themselves to do maintenance work on the process means. For these reasons, this type of cartridge system has been widely employed in the main bodies of the conventional image forming apparatuses.

Another type of cartridge configuration that can be used depending upon the life of the main process means has also been achieved, in which the process means is divided into long- and short-life groups and each group is integrated into a cartridge.

For example, a developing cartridge with a toner container or containers and developing means formed together therein, and a drum cartridge with an electrophotographic photosensitive body, charging means and cleaning means formed together therein have been adopted.

Recently, due to growth in demand for color electrophotographic image forming apparatuses capable of forming color images, expectations have been running for satisfaction of the following seven items: (a) low running cost, (b) small installation space, (c) low power consumption, (d) high quality, (e) high speed, (f) improved usability, and (g) ecology.

Conventional types of process cartridges and developing cartridges need to be replaced with new ones as soon as the cartridges run out of toner, which causes the following problems.

(1) In many cases, the above-mentioned cartridges are collected and recycled in cartridge-manufacturers' recycling systems or by private recycling dealers, but they may end up as waste.

It is therefore desirable to extend the life of the cartridges as long as possible, and hence to reduce the total amount of cartridge waste from environmental protection and resource saving standpoints. In other words, the life of the process means (such as an electrophotographic photosensitive body and a developing roller) and toner, both of which influence the life of the cartridge, need to be extended as long as possible.

In the event that the life of the process means is extended, an amount of toner corresponding to the life of the process means is supposed to be contained in the cartridge. The total weight of toner would increase in proportion to the life of the process means.

If the process means has a life span of up to 50,000 image copies, a required amount of toner will weigh 1.25 to 1.5 kg. If such a large amount of toner is contained in the cartridge, the total weight and volume will be necessarily increased, which runs the danger of reducing the operability.

(2) The main body of the image forming apparatus also needs a frame structure that can precisely support such a heavy cartridge, which results in an increase in the price of the entire apparatus.

(3) Further, in conventional toner replenishing type dual-component developing systems, a hopper for toner storage is provided in the main body of the image forming apparatus. In this case, toner is supplied from a toner replenishing container to the hopper, and to a developing device in this order.

In such a configuration, toner in the hopper can be used even if the toner replenishing container runs out of toner, which allows for a certain delay in exchanging cartridges.

The mechanism of the hopper part, however, increases the total number of parts, and hence the size of the cartridge, which also results in reducing the operability and increasing the total cost.

On the other hand, the time delay in exchanging cartridges makes it difficult not only to know the exact time to exchange cartridges, but also to measure the exact amount of residual toner in the toner replenishing container. This might cause trouble or image degradation in the process of image formation at the end of the life of toner, that is, as the toner replenishing container is running out of toner. Such a difference in image quality becomes visible especially in the formation of color images.

Since vivid color images cannot be formed even though there remains unused toner in the toner replenishing container, the time the cartridge needs replacing is brought forward, which makes it hard to effectively utilize resources despite the extended life cycle of the cartridge.

SUMMARY OF THE INVENTION

It is therefore an object of the present invention to provide an image forming apparatus capable of precisely detecting the remaining amount of developer in an inexpensive, compact configuration so that the timing of replacing a developer replenishing container can be delayed to make the developer replenishing container last longer.

In one aspect of the present invention, there is provided an image forming apparatus that uses a removable developer replenishing unit to control the replenishment of developer from the developer replenishing unit to an electrophotographic image forming body part so as to form images, the developer replenishing unit including a first storage for storing identification information related to identities of the developer and a second storage for storing history information related to the developer, the apparatus comprising: an information comparing means that reads out the identification information from the developer replenishing unit and compares the read-out identification information with unique information stored in the image forming body part to determine whether both pieces of information accord; a life judgment means that reads out the history information from the developer replenishing unit when the comparison result shows that both pieces of information accord, and analyzes the read-out history information to judge whether the utilization amount of the developer replenishing unit is at the end of its useful life; and an image forming control means that performs control of image formation when the judgment result shows that the utilization amount is not at the end of its useful life, by controlling the discharge amount of the developer replenished from the developer replenishing unit according to the read-out history information and image output information from the image forming body part.

The image forming control means may include a detection means for detecting image output information related to the density of an image formed in the image forming body part, a comparison means for comparing the detected image output information with a reference value to determine whether the image density is lower than the reference value, and a discharge controlling means for controlling the discharge amount of the developer discharged from the developer replenishing unit when the comparison result shows that the image density is lower than the reference value.

The discharge controlling means may include a feed amount deciding means for deciding the feed amount of the developer replenishing unit on the basis of the image output information detected, and a variable power control means for controlling the discharge amount of the developer by multiplying the decided feed amount by certain number varied according to the amount of the developer remaining in the developer replenishing unit.

The image forming apparatus may also comprise a utilization amount calculating means for calculating the utilization amount of the developer in the developer replenishing unit on the basis of the decided feed amount.

The image forming apparatus may further comprise a means for calculating, from the utilization amount calculated, the total amount of the developer consumed in the developer replenishing unit, and storing the total consumed amount into the second storage of the developer replenishing unit as the history information.

The history information stored in the second storage may contain threshold data indicative of the life of the developer replenishing unit for stopping the operation of the image forming body part, or threshold data for informing the user of the level of life span of the developer replenishing unit.

The history information stored in the second storage may also contain driving control threshold data indicative of the timing of multiplying the driving amount of the developer replenishing unit by a certain number, and data indicative of a coefficient for multiplying the driving amount of the developer replenishing unit by the certain number.

The history information stored in the second storage may further contain correction constants for use in calculating the amount of the developer consumed.

The correction constants stored in the second storage may include one or more of the following correction constants: a developer correction constant based on the kind of developer of the developer replenishing unit, a humidity correction constant based on variations in humidity of the developer, a utilization amount correction constant based on the utilization amount of the developer replenishing unit, a driving amount correction constant based on the driving amount of the developer replenishing unit, and a part history correction constant based on the parts constituting the developer replenishing unit.

The developer replenishing unit may perform the i-th cycle of replenishment such that a driving amount N of the developer replenishing unit is determined every time on the basis of output voltage from a developer density detecting means arranged in the image forming body part to make the developer replenishing unit feed the developer by the amount N, while a utilization amount $\Delta X$ is calculated from the driving amount N or an actual driving amount N' and the correction constants stored in the first storage of the developer replenishing unit to determine the total utilization amount X up to the i-th cycle as $X=X+\Delta X$ so as to store the total utilization amount X into the second storage of the developer replenishing unit before starting the next cycle of replenishment.

The developer replenishing unit may also perform replenishing operation such that a driving amount N of the developer replenishing unit is determined on the basis of output voltage from the developer density detecting means to control the driving of the developer replenishing unit by taking one turn as a unit to be repeated according to the driving amount N.

In another aspect of the present invention, there is provided an image forming method for forming images by using a removable developer replenishing unit and controlling the replenishment of developer from the developer replenishing unit to an electrophotographic image forming body part, the developer replenishing unit including a first storage for storing identification information related to identities of the developer and a second storage for storing history information related to the developer, the method comprising: an information comparing step of reading out the identification information from the developer replenishing unit and comparing the read-out identification information with unique information stored in the image forming body part to determine whether both pieces of information accord; a life judgment step in which when the comparison result shows that both pieces of information accord, the history information is read out from the developer replenishing unit and the read-out history information is analyzed to judge whether the utilization amount of the developer replenishing unit is at the end of its useful life; and an image forming control step in which when the judgment result shows that the utilization amount is not at the end of its useful life, image formation is controlled by controlling the discharge amount of the developer replenished from the developer replenishing unit according to the read-out history information and image output information from the image forming body part.

In still another aspect of the present invention, there is provided a medium with an image forming control program recorded thereon, the program instructing a computer to control the replenishment of developer from a removable developer replenishing unit to an electrophotographic image forming body part during image formation, the developer replenishing unit including a first storage for storing identification information related to identities of the developer and a second storage for storing history information related to the developer, the control program comprising the steps of: instructing the computer to read out the identification information from the developer replenishing unit and compare the read-out identification information with unique information stored in the image forming body part to determine whether both pieces of information accord; instructing the computer to read out the history information from the developer replenishing unit when the comparison result shows that both pieces of information accord, and analyze the read-out history information so as to judge whether the utilization amount of the developer replenishing unit is at the end of its useful life; and instructing the computer to control image formation when the judgment result shows that the utilization amount is not at the end of its useful life, by controlling the discharge amount of the developer replenished from the developer replenishing unit according to the read-out history information and image output information from the image forming body part.

In yet another aspect of the present invention, there is provided an image forming apparatus that uses a removable recording agent replenishing unit to control the replenishment of a recording agent from the recording agent replenishing unit to an electrophotographic image forming body part so as to form images, the recording agent replenishing unit including a first storage for storing identification information related to identities of the recording agent and a second storage for storing history information related to the recording agent, the apparatus comprising: an information comparing means that reads out the identification information from the recording agent replenishing unit and compares the read-out identification information with unique information stored in the image forming body part to determine whether both pieces of information accord; a life judgment means that reads out the history information from the recording agent replenishing unit when the comparison result shows that both pieces of information accord, and analyzes the read-out history information to judge whether the utilization amount of the recording agent replenishing unit is at the end of its useful life; and an image forming control means that performs control of image formation when the judgment result shows that the utilization amount is not at the end of its useful life, by controlling the discharge amount of the recording agent replenished from the recording agent replenishing unit according to the read-out history information and image output information from the image forming body part.

The image forming control means may include a detection means for detecting image output information related to the density of an image formed in the image forming body part, a comparison means for comparing the detected image output information with a reference value to determine whether the image density is lower than the reference value, and a discharge controlling means for controlling the discharge amount of the recording agent discharged from the recording agent replenishing unit when the comparison result shows that the image density is lower than the reference value.

The discharge controlling means may include a feed amount deciding means for deciding the feed amount of the recording agent replenishing unit on the basis of the image output information detected, and a variable power control means for controlling the discharge amount of the recording agent by multiplying the decided feed amount by a certain number varied according to the amount of the recording agent remaining in the recording agent replenishing unit.

The image forming apparatus may also comprise a utilization amount calculating means for calculating the utilization amount of the recording agent in the recording agent replenishing unit on the basis of the decided feed amount. The image forming apparatus may further comprise a means for calculating, from the utilization amount calculated, the total amount of the recording agent consumed in the recording agent replenishing unit, and storing the total consumed amount into the second storage of the recording agent replenishing unit as the history information.

In still another aspect of the present invention, there is provided an image forming method for forming images by using a removable recording agent replenishing unit and controlling the replenishment of a recording agent from the recording agent replenishing unit to an electrophotographic image forming body part, the recording agent replenishing unit including a first storage for storing identification information related to identities of the recording agent and a second storage for storing history information related to the recording agent, the method comprising: an information comparing step of reading out the identification information from the recording agent replenishing unit and comparing the read-out identification information with unique information stored in the image forming body part to determine whether both pieces of information accord; a life judgment step in which when the comparison result shows that both pieces of information accord, the history information is read out from the recording agent replenishing unit and the read-out history information is analyzed to judge whether the utilization amount of the recording agent replenishing unit is at the end of its useful life; and an image forming control step in which when the judgment result shows that the utilization amount is not at the end of its useful life, image formation is controlled by controlling the discharge amount of the recording agent replenished from the recording agent replenishing unit according to the read-out history information and image output information from the image forming body part.

In yet another aspect of the present invention, there is provided a medium with an image forming control program recorded thereon, the control program instructing a computer to control the replenishment of a recording agent from a removable recording agent replenishing unit to an electrophotographic image forming body part during image formation, the recording agent replenishing unit including a first storage for storing identification information related to identities of the recording agent and a second storage for storing history information related to the recording agent, the control program comprising the steps of: instructing the computer to read out the identification information from the recording agent replenishing unit and compare the read-out identification information with unique information stored in the image forming body part to determine whether both pieces of information accord; instructing the computer to read out the history information from the recording agent replenishing unit when the comparison result shows that both pieces of information accord, and analyze the read-out history information so as to judge whether the utilization amount of the recording agent replenishing unit is at the end of its useful life; and instructing the computer to control image formation when the judgment result shows that the utilization amount is not at the end of its useful life, by controlling the discharge amount of the recording agent replenished from the recording agent replenishing unit according to the read-out history information and image output information from the image forming body part.

According to the present invention, the image forming apparatus uses the developer replenishing unit that includes the first storage for storing identification information related to identities of developer and the second storage for storing history information related to the developer. The identification information is read out from the developer replenishing unit, and the read-out identification information is compared with unique information stored in the image forming body part to determine whether both pieces of information accord. If both accord, the history information is read out from the developer replenishing unit and the read-out history information is analyzed to judge whether the utilization amount of the developer replenishing unit is at the end of its useful life. If the utilization amount is not at the end of its useful life, the discharge amount of the developer replenished from the developer replenishing unit is controlled according to the read-out history information and image output information from the image forming body part. This configuration allows precise detection of the remaining amount of the developer, and hence further reduction on the amount of toner remaining in the developer replenishing unit. Consequently, stable replenishment of toner is possible even at the end of its useful life, which also makes it possible to delay the timing of replacing the developer replenishing container and hence to make the developer replenishing container last longer.

Further, according to the present invention, the amount of toner consumption can be estimated more precisely, so that the user can be informed more exactly when the developer replenishing unit needs replacing.

Furthermore, according to the present invention, the above-mentioned configuration does not need the hopper part as required in the conventional, which makes the entire apparatus inexpensive and compact.

Other objects and aspects of the present invention will become apparent from the following description of an embodiment with reference to the accompanying drawings.

DESCRIPTION OF THE PREFERRED EMBODIMENTS

Figure 1:
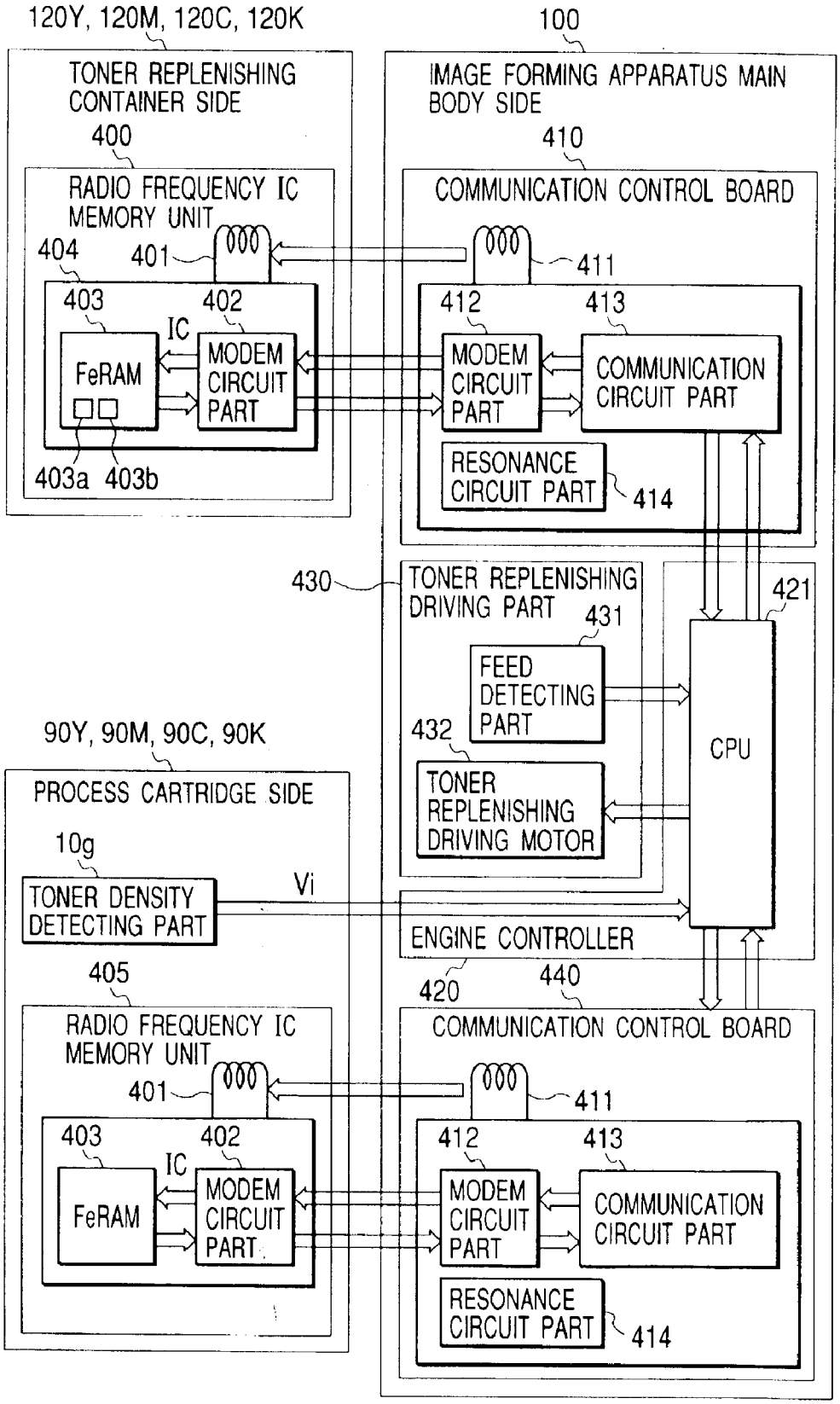
FIG. 1 is a schematic block diagram showing an electrical system configuration of a radio frequency IC memory unit in a toner replenishing container and a communication control part of a laser printer according to the present invention.

A preferred embodiment of the present invention will now be described in detail hereinafter with reference to the accompanying drawings.

(Outline)

The outline of the present invention will be first described.

(1) In a first aspect of the present invention, there is provided a system using at least one developer replenishing container provided with a recording medium having a pre-recorded first storage area and a second storage area renewable by a recording means of an image forming body part, for discharging developer from the developer replenishing container to the image forming body part side by means of a developer discharging means, wherein the image forming body part has:

- a function for controlling the operation of the developer discharging means on the basis of data stored in the first and second storage areas in such condition that the developer replenishing container is mounted;
- a function for making possible image formation when a value of data A stored in the first storage area accords with a value of data A' held by a storage means of the image forming body part, the data A stored in the first storage area being ID data related to the developer replenishing container to which the recording medium is attached; and
- a function for confirming the ID data to determine whether two or more developer replenishing containers are placed in position respectively, and if it is determined that they are not in position, a user is informed of the error.

(2) In a second aspect of the present invention, the system according to the first aspect of the present invention is such that the image forming body part has:

- a function for making possible image formation when it is judged that a value of data X indicative of the utilization amount of the developer replenishing container stored in the second storage area does not reach a value of data B stored in the first storage area, the data B stored in the first storage area being at least one kind of data containing threshold data indicative of the life of the developer replenishing container for stopping the image forming body part or threshold data for informing the image forming body part of the level of life span of the developer replenishing container; and
- a function for comparing the threshold data with data on the utilization amount to inform the user exactly when the developer replenishing container needs replacing and to stop the image forming body part as soon as the developer replenishing container has run out of developer so as to prevent failures of the cartridge and an intermediate transfer belt.

(3) In a third aspect of the present invention, the system according to the first aspect of the present invention is such that the image forming body part has:

- a function for controlling driving of the developer discharging means on the basis of output voltage from a developer density detecting means in such condition that the developer replenishing container is mounted in the image forming body part;

a function for controlling the feed amount of the developer discharging means to be multiplied by a certain number on the basis of a value of data D stored in the first storage area when a judgment means in the image forming apparatus judges that the data X indicative of the utilization amount of the developer replenishing container stored in the second storage area has reached a value of data C stored in the first storage area, the data C as feed amount control threshold data indicative of the timing of multiplying the feed amount of the developer discharging means by a certain number and the data D indicative of a coefficient for multiplying the feed amount of the developer discharging means by the certain number being stored in the first storage area in the developer replenishing container unit; and a function for making it possible to further reduce the amount of residual toner remaining in the developer replenishing container by multiplying the feed amount of the developer discharging means by a certain number according to the feed amount control threshold data so that stable toner replenishment is possible even at the end of its useful life.

(4) In a fourth aspect of the present invention, the system according to the first aspect of the present invention is such that the image forming body part has:

a function for performing the i-th cycle of replenishment in such a way that a driving amount N of the developer discharging means is determined every time on the basis of an output voltage from the developer density detecting means to make the developer-discharging means feed developer by the amount N;

a function for calculating a utilization amount $\Delta X$ from the driving amount N or an actual driving amount N' and a correction constant stored in the first storage area of the developer replenishing container to calculate the total utilization amount X up to the i-th cycle as $X=X+\Delta X$ so as to store the total utilization amount X into the second storage area of the developer replenishing container before starting the next cycle of replenishment, the correction constant for calculating the utilization amount $\Delta X$ being stored in the first storage area in the developer replenishing container; and a function for using the correction constant to correct variations in utilization amount due to the use environment of the developer replenishing container or the kind of developer used so that the utilization amount can be estimated more precisely, thereby informing the user more exactly when the developer replenishing container unit needs replacing.

(Specific Example)

The present invention will be described below by taking a specific example.

In the image forming apparatus according to the present invention, toner replenishing containers in which various kinds of toner are stored independently and cartridges (process cartridges or developing cartridges) connectable to the toner replenishing containers are removably mounted in an image forming body part independently of one another.

In other words, the image forming apparatus assumes a toner replenishing type dual-component developing system that makes the consumable cartridges last longer and replenishes required kinds of toner from the toner replenishing containers to the cartridges.

In this example of the toner replenishing type dual-component developing system, the image forming body part is not provided with a hopper part as required in the conventional system. It is therefore necessary to detect the exact time when the toner replenishing containers need replacing.

This example assumes an electrophotographic color image forming apparatus. It should be noted that in the following description the longitudinal direction means a direction perpendicular to the direction to feed a recording medium 2 and identical to an axial direction of an electrophotographic photosensitive body (hereinbelow, called a photosensitive drum 7). Further, the term "right and left" represents the right and lift as seen from the direction to feed the recording medium 2. Furthermore, the term "up and down" represents the up and down in such condition that the cartridge is mounted.

(System Configuration)

Referring first to FIGS. 14 to 20, a system configuration of the electrophotographic color image forming apparatus will be described in brief.

Figure 14:
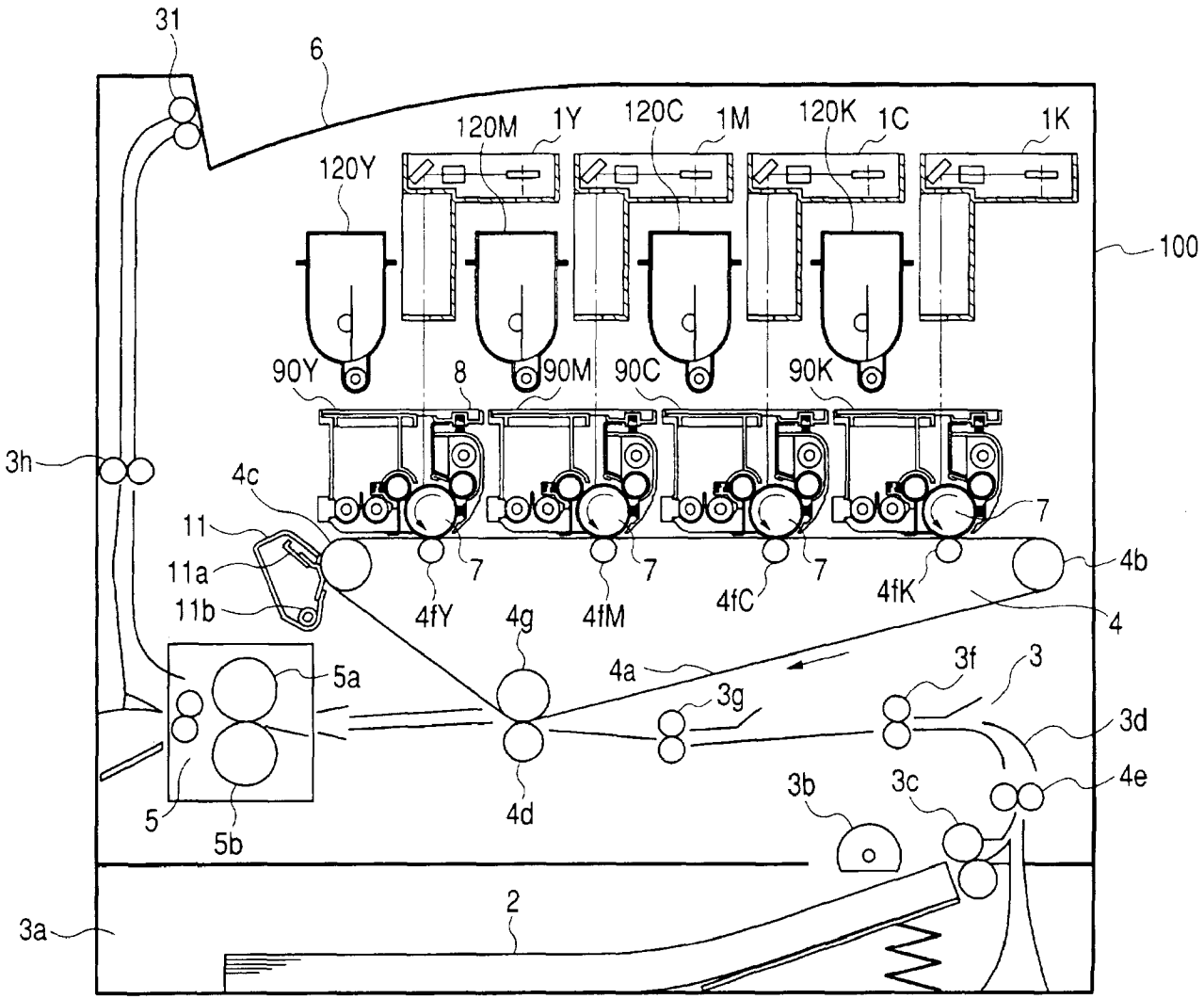
FIG. 14 is a sectional view showing a configuration of a color laser printer.

FIG. 14 shows the general structure of a color laser printer as the color image forming apparatus.

In an image forming part of the color laser printer, four process cartridges 90Y, 90M, 90C and 90K (for yellow, magenta, cyan and black), each of which is provided with a photosensitive drum 7 as an image carrier, and exposure parts 1Y, 1M, 1C and 1K (each of which is composed of a laser-beam optical system) provided above the process cartridges 90Y, 90M, 90C and 90K as corresponding to respective colors of the process cartridges 90Y, 90M, 90C and 90K are arranged in position, respectively.

Further, below the image forming part, a sheet feeding part for feeding the recording medium 2, an intermediate transfer belt 4*a* for transferring a toner image formed on each photosensitive drum 7, and a secondary transfer roller 4*d* for transferring the toner image on the intermediate transfer belt 4*a* to the recording medium 2 are arranged in position.

Furthermore, a fixing part for fixing the toner image transferred onto the recording medium 2 and an sheet ejecting part for ejecting and stacking the recording medium 2 outside the apparatus are arranged in position.

The recording medium 2 may be paper, OHP sheet or cloth.

The image forming apparatus is a cleanerless system in which residual toner remaining after transfer on the photosensitive drum 7 is collected into a developing part. No cleaners exclusively used for collecting and storing the residual toner after transfer are arranged within the process cartridges.

It should be noted that the electrophotographic image forming apparatus denotes an apparatus for forming images using an electrophotographic image forming process.

For example, the electrophotographic image forming apparatus includes an electrophotographic copying machine, an electrophotographic printer (such as an LED printer and laser printer), an electrophotographic facsimile and an electrophotographic word processor.

The process cartridge means a cartridge in which at least one of a charging part, a developing part and a cleaning part is integrated together with the photosensitive drum 7 as the image carrier into a cartridge, and the cartridge is removably mounted in the image forming body part.

On the other hand, the developing cartridge means a cartridge into which a toner storage part and a developing part are integrated, and the cartridge is removably mounted in the image forming body part.

The following describes each part of the color image forming apparatus in detail sequentially.

(Paper Feeding Part)

The paper feeding part is to feed the recording medium 2 to the image forming part. The paper feeding part is mainly composed of a paper feed cassette 3*a* with two or more sheets of the recording medium 2 are stacked thereon and stored therein, a feeding roller 3*b*, a retard roller 3*c* for preventing double feeding, a feeding guide roller 3*d* and a registration roller 3*g*.

The feeding roller 3*b* is driven to rotate in response to the start of image forming operation so as to separate and feed the recording medium 2 one by one from the feed cassette 3*a*. The recording medium 2 is guided by the feeding guide roller 3*d* and fed to the registration roller 3*g* via transfer rollers 3*e* and 3*f*.

The registration roller 3*g* is at a rest immediately after the recording medium 2 is fed, so that a skew of the recording medium 2 is corrected when the recording medium 2 strikes against a nip part of the registration roller 3*g*.

During image formation, the registration roller 3*g* performs a nonrotating operation for making the recording medium 2 stand still on standby, and a rotating operation for feeding the recording medium 2 toward the intermediate transfer belt 4*a* in a certain sequence to register the toner image on the recording medium 2 for the next transfer process.

(Process Cartridge)

Each of the process cartridges 90Y, 90M, 90C and 80K arranges and integrally forms the charging part and the developing part around the photosensitive drum 7 as the image carrier. Since it is easy for any user to remove the cartridge from the apparatus main body, the user replaces the cartridge when the photosensitive drum 7 is at the end of its life span.

For example, in this case, the number of times the photosensitive drum 7 rotates is counted to inform the user that the process cartridge is at the end of its life span as soon as the count has exceeded a predetermined number of counts.

The photosensitive drum 7 of this example is a negative, organic photosensitive body having a photosensitive layer on an aluminum drum base of about 30 mm in diameter with a charge-injection layer provided on the outermost layer. The photosensitive drum 7 is driven to rotate at a certain process speed, for example, of 117 mm/sec in this case.

The charge-injection layer is a coated layer made of conductive particles, for example, SnO2 ultra-fine particles suspended in a nonconductive resin binder.

Figure 15:
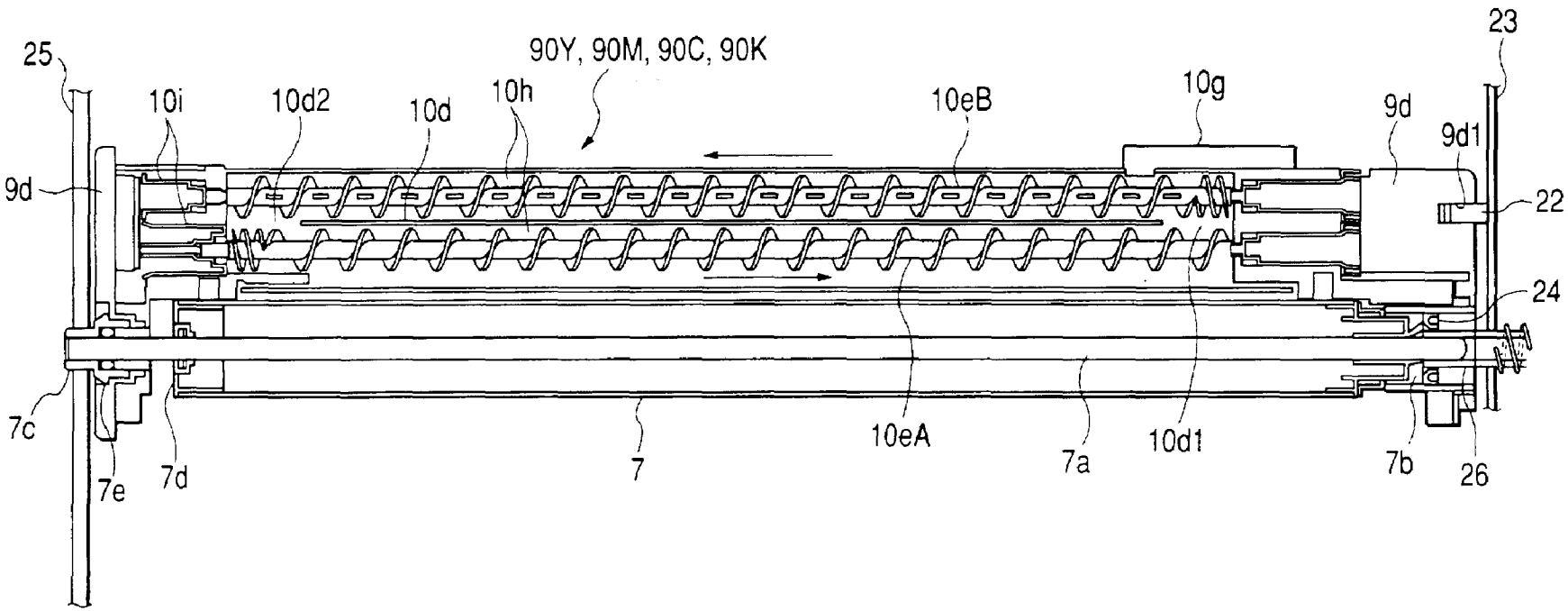
FIG. 15 is a sectional view showing a configuration of a toner cartridge.

As shown in FIG. 15, a drum flange 7*b* is fixed at the back end of the photosensitive drum 7, and a nondriving flange 7*d* is fixed at the fore end.

A drum shaft 7*a* is penetrated at the center of the drum flange 7*b* and the nondriving flange 7*d* so that the drum shaft 7*a*, the drum flange 7*b* and the nondriving flange 7*d* are rotated as a unit. In other words, the photosensitive drum 7 is rotated around the axis of the drum shaft 7*a*.

A bearing 7*e* is rotatably supported at the fore end of the drum shaft 7*a* and fixed to a bearing case 7*c*. The bearing case 7*c* is fixed to a frame of the process cartridge.

(Charging Part)

Figure 16:
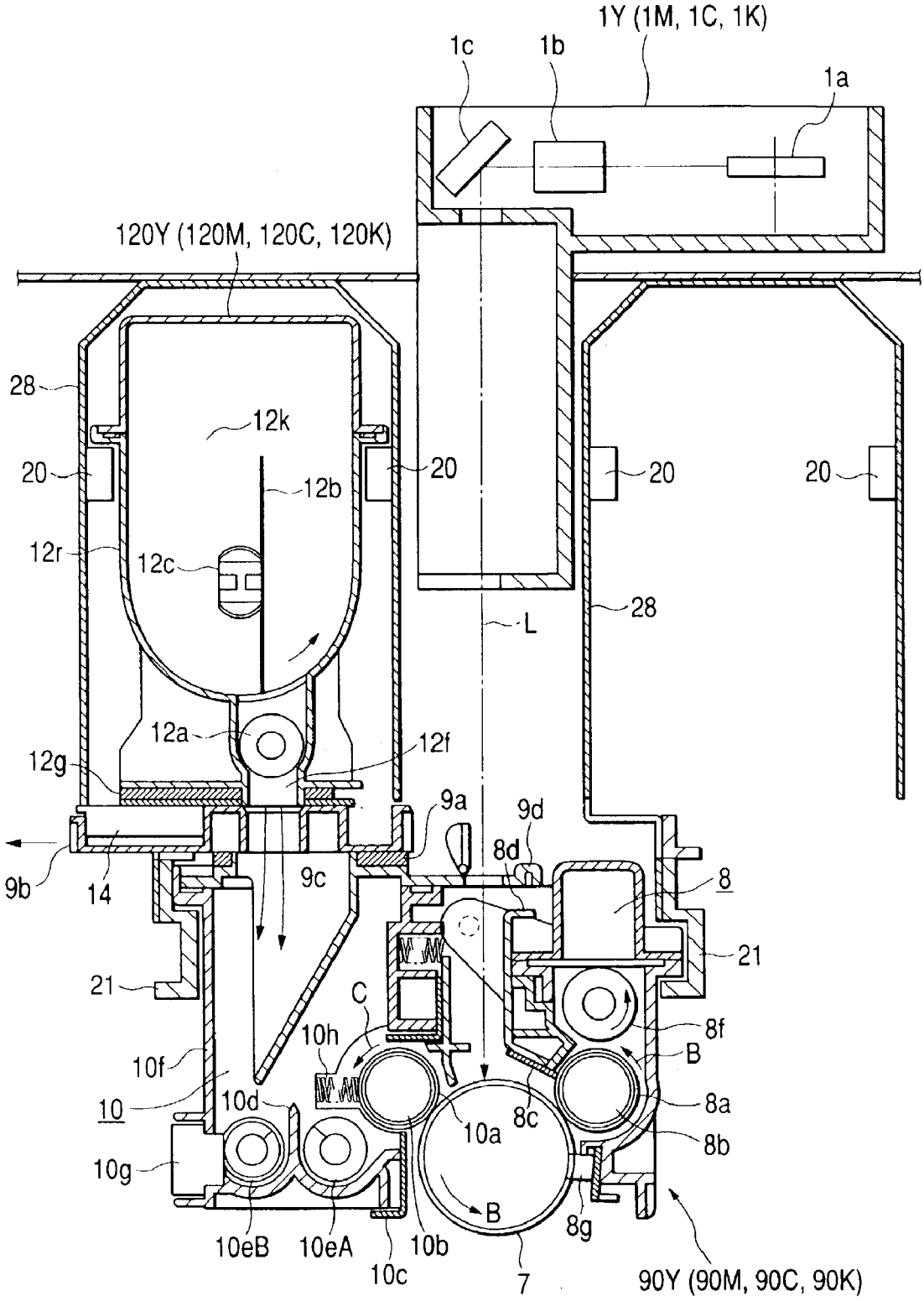
FIG. 16 is a sectional view showing a state where the toner replenishing container and the toner cartridge are assembled.

In FIG. 16, the charging part is a magnetic brush charging device 8 using magnetic particles as charging material. This embodiment uses a contact charging method.

To be specific, the charging device 8 has a magnetic brush part as the charging material made by magnetically restraining conductive magnetic particles. The magnetic brush part is brought into contact with the photosensitive drum 7 while applying voltage, thus charging the surface of the photosensitive body.

Such a charging process (the process of charging a charged body by direct injection of electrical charges) is called "injection charging." The use of the injection charging process eliminates the need for a cleaning mechanism (including a cleaning blade, a cleaning roller and the like) which mechanically scrapes and removes residual toner from the surface of the photosensitive drum 7. This cleaning system will be described later.

In this embodiment, since the injection charging process charges the charged body without the need for discharge phenomena caused by a corona charger, charging bias needed for charging is applied by such a small amount that it corresponds to a desired surface potential of the charged body, which makes it possible to achieve not only perfect ozone-less charging without the occurrence of ozone, but also low-power consumption.

(Magnetic Brush Charging Device)

Next, the magnetic brush charging device 8 will be described in detail.

In FIG. 16, the magnetic brush charging device 8 forms a magnetic brush layer of magnetic particles on a charging sleeve 8*a* with a magnet roller 8*b* included therein so that the photosensitive drum 7 will be charged to a desired potential in a contact part between the photosensitive drum 7 and the brush.

The charging sleeve 8*a* is so arranged that about half of its circumferential face on the left side is sticks out of an opening of a charging container along the longitudinal direction, while about half of its circumferential face on the right side is exposed to the outside. The magnetic particles are stored in the charging container. The surface of the charging sleeve 8*a* is made rough and uneven enough to entrap and carry the magnetic particles.

The magnet roller 8*b* provided inside the charging sleeve 8*a* becomes four-pole magnetized along the circumferential direction. Then the magnet roller 8*b* is so fixed that one magnetic pole, that is, an S1 pole faces to the center of the photosensitive drum 7, thereby preventing the magnetic particles from separating from the surface of the photosensitive drum 7 due to the rotation of the photosensitive drum 7.

A plate-shaped nonmagnetic regulating blade 8*c* is spaced with the surface of the charging sleeve 8*a*. The magnetic particles are carried by the magnet roller 8*b* and fed by the rotation of the charging sleeve 8*a* in the direction of the arrow. Then the magnetic particles form a magnetic brush part on the surface of the charging sleeve 8*a* with maintaining a certain amount of thickness by means of the regulating blade 8*c*.

The charging sleeve 8*a* is arranged opposite to the photosensitive drum 7 with such a certain space that the magnetic brush part will be brought into contact with the surface of the photosensitive drum 7 to form a charged nip part. The width of the charged nip part is an important measure of how much the photosensitive drum 7 is charged, and in the embodiment, the space between the charging sleeve 8*a* and the photosensitive drum 7 is so adjusted that the width of the nip part becomes about 6 mm.

The charging sleeve 8*a* is driven by a motor, not shown, to rotate in the direction of arrow B, that is, it rotates opposite in direction to the rotation of the photosensitive drum 7. In the embodiment, the photosensitive drum 7 rotates at a speed $V_1$ while the charging sleeve 8*a* rotates in the opposite direction with a speed ratio of $V_2 \cong 1.5 \times V_1$.

The higher the relative speed between the photosensitive drum 7 and the magnetic brush part, the more the chance of contact therebetween increases, which makes it possible to improve not only the uniformity of charging, but also the ability to take, into the magnetic brush, residual toner remaining after transfer.

A predetermined charging bias is applied from a charging bias power source (not shown) to the magnetic brush part through the charging sleeve 8*a*. Then the surface of the photosensitive drum 7 is brought into contact with the magnetic brush part in the nip part, and charged to predetermined polarity and potential.

The conductive magnetic particles, which form the magnetic brush part, may be magnetic metal particles, such as ferrite or magnetite, or the conductive magnetic particles settled in a resin are also usable.

A stirring member 8*f* is rotatably supported between both end wall faces of the charging container in such condition that it is placed above and substantially in parallel with the charging sleeve 8*a*.

The charging brush 8*g* is brought into contact with the surface of the photosensitive drum 7 with 1 mm of bite in thickness to apply a predetermined voltage. Contacting the charging brush 8*g* causes residual toner remaining on the photosensitive drum 7 to spread out uniformly. Then the absorbed charges are released from the photosensitive drum 7, preparing for uniform electrification in the next process.

(Cleanerless System)

Next, a description will be made about a cleanerless system of a reverse developing system that negatively charges the photosensitive drum 7 to develop toner negatively charged in exposed parts of low potential.

In FIG. 16, most of the positively charged particles of the residual toner slightly remaining after transfer on the photosensitive drum 7 are electrostatically taken into the magnetic brush charging device 8, while the remaining residual toner is collected by the brush forcedly scraping off the toner from the photosensitive drum 7. Then the collected toner particles are rubbed with the magnetic particles in the charging device 8, and negatively charged before released onto the photosensitive drum 7.

On the other hand, most of the negatively charged particles of the residual toner remaining after transfer are collected into a developing device 10, together with the above-mentioned toner particles released from the charging device 8, without being taken into the magnetic brush charging device 8 (cleaning coinciding with developing).

In this process of cleaning coinciding with developing, the toner particles are taken into the developing device 10 by applying a bias for eliminating developing fog. The bias for eliminating developing fog denotes a difference in potential for developing fog between voltage applied to the developing device and surface potential of the photosensitive drum 7.

The use of this process allows the toner particles remaining after transfer to be collected into the developing device for use in the next process: some via the magnetic brush charging device, and the other directly. Therefore, waste toner is eliminated, and hence troublesome maintenance work can be reduced. Further, since this system is cleanerless, it also has the advantage of eliminating the need for a cleaner space, resulting in a significant reduction in the overall apparatus size.

(Exposure Unit)

In the embodiment, a laser exposure means is used to expose the photosensitive drum 7. In other words, as soon as an image signal is sent from the apparatus main body, the uniformly-charged surface of the photosensitive drum 7 is scanned and exposed with a laser beam L modulated according to the signal. Thus a latent image corresponding to the image information is selectively formed on the surface of the photosensitive drum 7.

As shown in FIG. 16, the laser exposure means is composed of a solid-state laser element (not shown), a polygon mirror 1*a*, an image forming lens 1*b*, a reflecting mirror 1*c*, and so on. The solid-state laser element is controlled by a light emitting signal generator (not shown) to turn on or off its light emission at predetermined timing on the basis of the input image signal.

The laser beam L emitted from the solid-state laser element is converted by a collimator lens system (not shown) into a flux of substantially parallel beams, which are scanned by the polygon mirror 1*a* rotating at high speed. Then the luminous flux is focused on a spot on the photosensitive drum through the image forming lens 1*b* and the reflecting mirror 1*c* to form a spot image.

The surface of the photosensitive drum 7 is exposed in the main scanning direction with the laser light and in the subscanning direction along with the rotation of the photosensitive drum 7, thereby obtaining an exposure distribution corresponding to the image signal.

Further, radiation and nonradiation of the laser beam L produce light-part potential with a drop of surface potential and dark-part potential. The contrast between the light-part potential and the dark-part potential forms a latent image corresponding to the image information.

(Developing unit)

Next, the developing unit will be described with reference to FIG. 16.

The developing device 10 as the developing unit is of dual-component contact-type (dual-component magnetic-brush type) in which developer composed of carrier and toner is carried on a developing sleeve 10*a* as a developer carrier with a magnet roller 10*b* included therein.

A regulating blade 10*c* is spaced with the developing sleeve 10*a* to form a thin layer of developer on the developing sleeve 10*a* as the developing sleeve 10*a* rotates in the direction of arrow C.

The developing sleeve 10*a* is spaced with the photosensitive drum 7, and the space is so set that the developer will come into contact with the photosensitive drum 7 at the time of developing. In the developing unit, the developing sleeve 10*a* is driven to rotate at a predetermined peripheral speed in the counterclockwise direction, as indicated by arrow C, that is, it rotates opposite in direction to the rotation of the photosensitive drum 7 as shown by arrow B.

The toner used in the embodiment is negatively charged toner of 6 μm in mean diameter, while the magnetic carrier is of 35 μm in mean diameter and its saturation magnetization is 205 emu/cm$^3$. Then, a mixture, mixed 8 parts toner to 92 parts carrier by weight, is applied as the developer.

A developer storage part 10*h* in which the developer is circulated is divided into two compartments by a partition 10*d* extending in the longitudinal direction except both ends of the developer storage part 10*h*. Stirring screws 12*a*-10*e*A and 12*a*-10*e*B are arranged on both sides of the partition 10*d*.

The toner replenished from the toner replenishing container falls on the front side of the stirring screw 12*a*-10*e*B. Then the toner is stirred and sent to the back side in the longitudinal direction, and passed through a gap in the partition 10*d* provided at the backmost end of the partition 10*d*. The toner is further sent to the front side in the longitudinal direction by the stirring screw 12*a*-10*e*A, passed through a gap in the partition 10*d* provided at the foremost end of the partition 10*d*, and sent and stirred by the stirring screw 12*a*-10*e*B again. Thus this circulation process is repeated.

The following describes a developing process and a developer circulating system. The developing process is to develop the latent image formed on the photosensitive drum 7 to reveal the image by a dual-component magnetic-brush technique using the developing device.

As the developing sleeve 10*a* rotates, the developer is dipped up at an N3 pole of the magnet roller 10*b* from the developer container onto the surface of the developing sleeve 10*a*, and carried on the developing sleeve 10*a*.

While being carried, the developer is regulated in thickness by the regulating blade 10*c* arranged in position perpendicular to the developing sleeve 10*a* to form a thin layer of developer on the developing sleeve 10*a*.

Then, when the thin layer of developer is fed to a developing N1 pole corresponding to the developing part, the magnetic force forms a spicate rising part of developer. The latent image on the photosensitive drum 7 is developed as a toner image by toner particles contained in the spicate rising developer. In the embodiment, the latent image is reversely developed.

After passing through the developing part, the thin layer of developer on the developing sleeve 10*a* in turn enters the developer container as the developing sleeve 10*a* rotates. Then the developer is separated from the developing sleeve 10*a* by repulsive magnetic fields of N2 and N3 poles, and returned to a developer reservoir in the developer container.

The developing sleeve 10*a* is applied with direct (DC) voltage and alternating (AC) voltage from a power source, not shown. In the embodiment, a direct voltage of −500 V and an alternating voltage the peak-to-peak voltage of which is 1500 V at a frequency of 2000 Hz are applied to the developing sleeve 10*a*, and only the exposed part of the photosensitive drum 7 is selectively developed.

In the dual-component developing process, the application of the alternating voltage generally increases the developing efficiency to make the quality of the resulting image higher, but it also makes it easier to cause fogging. Therefore, a potential difference between the direct voltage applied to the developing sleeve 10*a* and the surface potential of the photosensitive drum 7 is generally provided so that fogging cannot happen to the images. To be more specific, a bias voltage between the potential of the exposed part and the potential of the unexposed part on the photosensitive drum 7 is applied to the developing sleeve 10*a*.

The potential difference for preventing fogging is called potential for eliminating developing fog ($V_{back}$). The potential difference prevents toner from adhering to a nonimage area (unexposed part) on the photosensitive drum 7 at the time of developing, while it collects residual toner remaining after transfer on the photosensitive drum 7 in the cleanerless system, that is, in a configuration where cleaning coincides with developing.

In the developing process, toner is consumed and the density of toner is lowered. In the embodiment, an inductance sensor 10*g* for detecting the density of toner is arranged in a position adjacent to the circumferential surface of the stirring screw 12*a*-10*e*B. When the inductance sensor 10*g* detects that the density of toner become lower than a predetermined density level, the toner replenishing container is instructed to replenish toner into the developing device. This operation for replenishing toner makes it easy to maintain and manage the density of toner in developer constantly in a predetermined level.

(Toner Replenishing Container)

Referring next to FIGS. 14, and 16 through 18, an arrangement of toner replenishing containers will be described.

In FIG. 14, toner replenishing containers 120Y, 120M, 120C and 120K are arranged in parallel with and above the process cartridges 90Y, 90M, 90C and 90K, and inserted into the apparatus main body from the front side.

Figure 17:
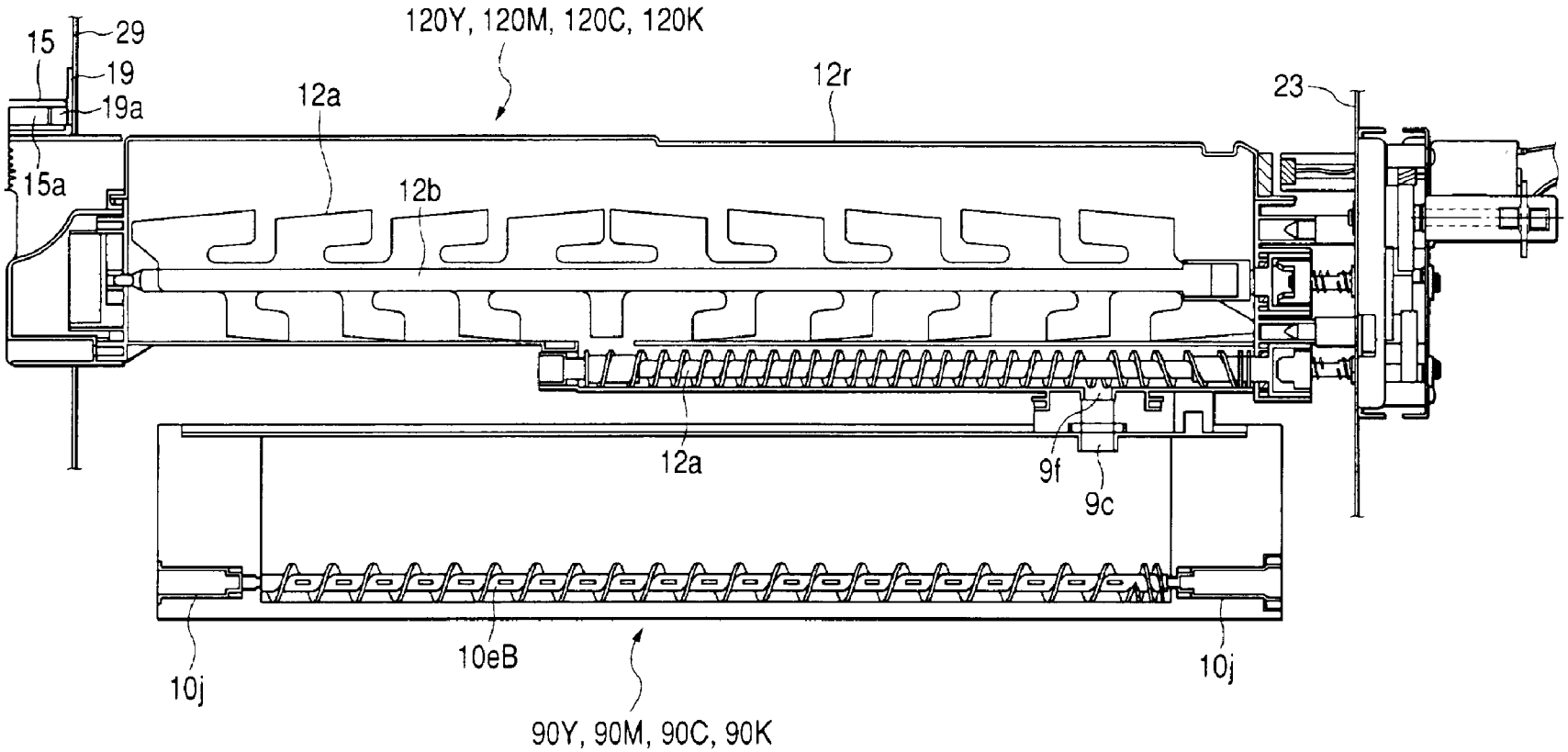
FIG. 17 is a sectional view of the toner replenishing container and the toner cartridge as seen from the longitudinal direction.

In FIGS. 16 and 17, stirring plates 12*b* fixed to a stirring shaft 12*c* and the screw 12*a* are arranged inside each toner replenishing container, while a discharge opening 12*f* from which toner is discharged is formed on the bottom of the container.

Figure 18:
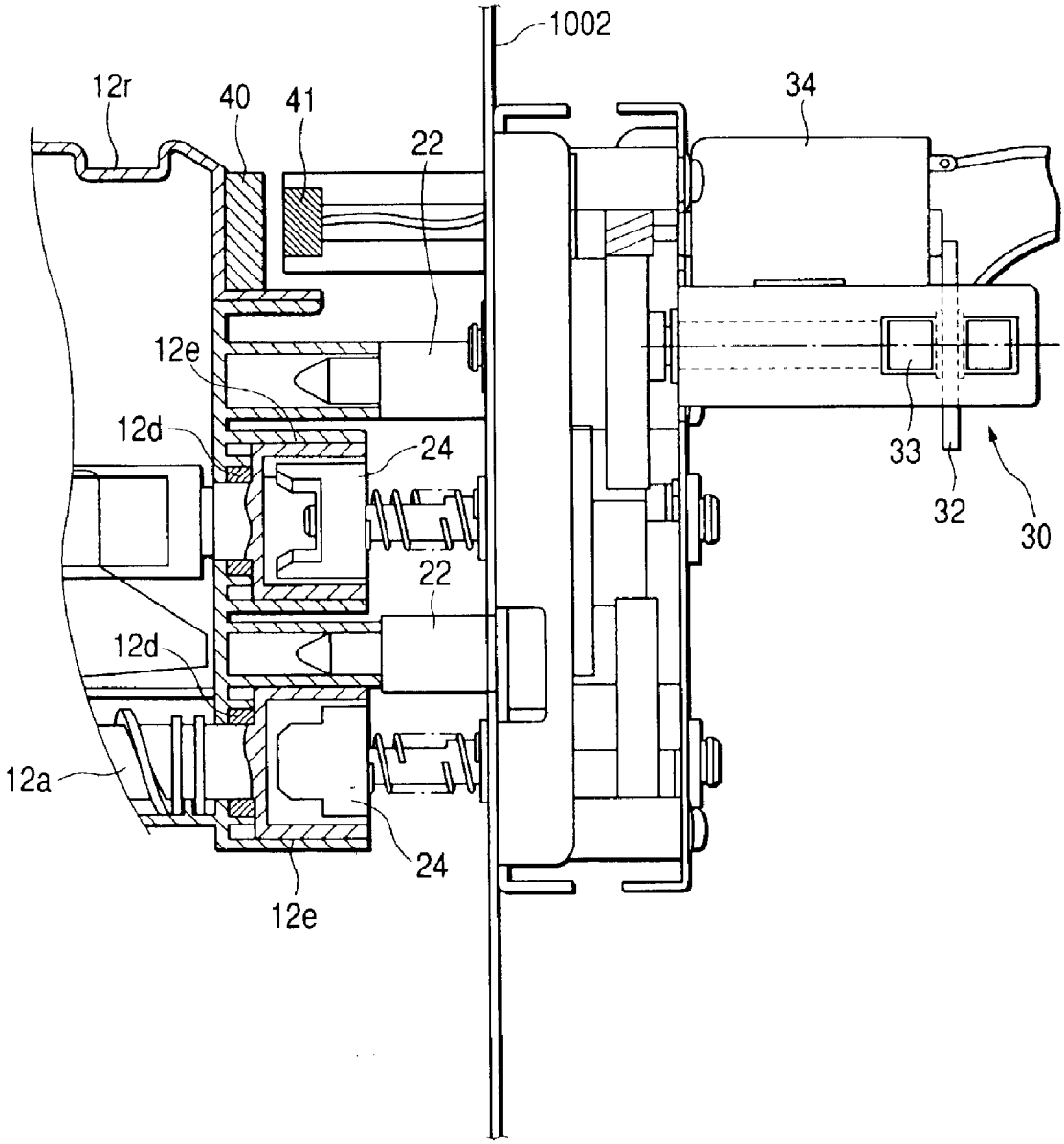
FIG. 18 is a sectional view showing the longitudinal backside of the toner replenishing container.
Figure 19:
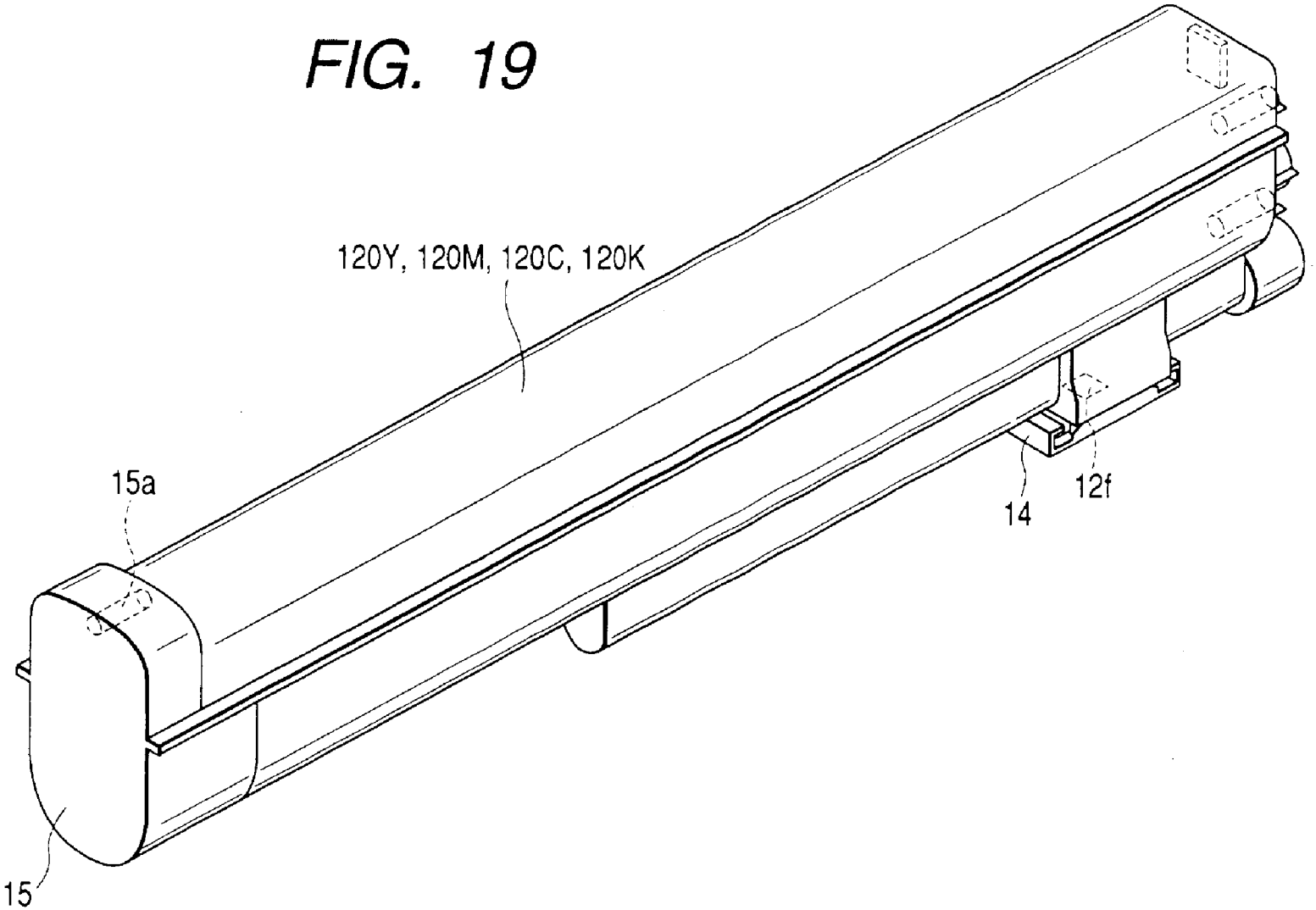
FIG. 19 is a perspective view showing the appearance of the toner replenishing container.

In FIG. 18, the screw 12*a* and the stirring shaft 12*c* are rotatably supported by bearings 12*d* at both ends, with a driving coupling (concave part) 12*e* arranged at one end. The driving coupling (concave part) 12*e* is driven to rotate by a driving force transmitted from a driving coupling (convex part) 24 of the apparatus main body.

The screw 12*a* is shaped into a spiral rib, which reverses its twisted direction relative to the discharge opening 12*f*.

As the driving coupling (convex part) 24 rotates, the screw 12*a* is rotated in a predetermined direction to let toner fall from the discharge opening 12*f*, thus replenishing toner into the process cartridge.

The tip of each stirring plate is inclined toward the radius of the rotational direction, so that the tip is brought into contact with and rubbed against the wall surface of the toner replenishing container at an angle. To be specific, the tip of the stirring plate is twisted in a spiral state. Thus the tip of the stirring plate is so twisted and inclined that it causes a feeding force in the axial direction to send toner in the longitudinal direction.

It should be noted that in the embodiment the toner replenishing container is not limited to the dual-component developing type, and it can replenish toner into any process cartridge or developing cartridge of one-component developing type. Further, powder to be stored in the toner replenishing container is not limited to toner, and it may, of course, be developer made of a mixture of toner and magnetic carrier.

(Transfer Part)

Next, a transfer part will be described.

In FIG. 14, an intermediate transfer unit 4 as the transfer part is to secondarily transfer, onto the recording medium 2 in a batch, two or more toner images primarily transferred from the photosensitive drum 7 one by one and overlapped one upon another.

The intermediate unit 4 is provided with an intermediate transfer belt 4*a* traveling in the direction of the arrow. The intermediate transfer belt 4*a* is traveling in the clockwise direction as indicated by the arrow at substantially the same peripheral speed as that of the photosensitive drum 7. The intermediate belt 4*a* is an endless belt of about 940 mm in perimeter, and is wound around three rollers, namely, a driving roller, a secondary transfer opposed roller 4*g* and a driven roller.

Further, charging transfer rollers 4*f*Y, 4*f*M, 4*f*C and 4*f*K are rotatably arranged inside the intermediate belt 4*a* in a position opposite to the respective photosensitive drums 7, and pressurized toward the axis of the photosensitive drums 7, respectively.

The charging transfer rollers 4*f*Y, 4*f*M, 4*f*C and 4*f*K are supplied with power from a high-pressure power source (not shown) to charge toner to a reverse polarity from the reverse side of the intermediate belt 4*a* so as to perform primary transfer of toner images one by one on the photosensitive drum 7.

The intermediate belt 4*a* can be made of polyimide resin, but it is not limited to polyimide resin, and other materials may be used properly. For example, the intermediate belt 4*a* can also be made of plastic rubber such as polycarbonate resin, polyethylene terephthalate resin, polyfluorovinilidene resin, polyethylene naphthalate resin, polyetheretherketone resin and polyether sulfone resin. Fluororubber and silicon rubber are suitable for the intermediate transfer belt 4*a* as well.

As a secondary transfer part, a secondary transfer roller 4*d* as a transfer member is pressed against the intermediate transfer belt 4*a* in a position opposite to the secondary transfer opposed roller 4*g*. The secondary transfer roller 4*d* is so fixed that it can slide up and down as shown. Thus, when the intermediate transfer belt 4*a* needs replacing, or a jam takes place in the secondary transfer part, the secondary transfer roller 4*d* can be withdrawn to a predetermined position where the above-mentioned work is made possible.

The intermediate belt 4*a* and the secondary transfer roller 4*d* are driven individually, and a predetermined bias is applied to the secondary transfer roller 4*d* as soon as the recording medium 2 enter the secondary transfer part, thus secondarily transferring the toner image from the intermediate transfer belt 4*a* onto the recording medium 2.

During the transfer process, the recording medium 2, which is sandwiched between the intermediate belt 4*a* and the secondary transfer belt 4*d*, is fed at a predetermined speed in the left direction as shown toward a fixing device 5 for the next process.

A cleaning unit capable of separating from or contacting with the intermediate transfer belt 4*a* is provided in a predetermined position of the intermediate transfer belt 4*a* corresponding to the last stage of the transfer process, so that residual toner remaining after transfer is removed from the surface of the intermediate transfer belt 4*a*.

A cleaning blade 11*a* is arranged inside the cleaning unit 11 for removing residual toner after transfer. The cleaning unit is so arranged that it can swing about the center of rotation (not shown). The cleaning blade 11*a* is pressed against the intermediate transfer belt 4*a* to bite into the intermediate transfer belt 4*a*. Thus, the residual toner taken in the cleaning unit 11 is fed by the feed screw 12*a*-11*e*B to a waste toner tank (not shown).

(Fixing Part)

Next, a fixing part will be described.

In FIG. 14, the toner image formed on the photosensitive drum 7 by means of the above-mentioned developing part is transferred onto the recording medium 2 through the intermediate transfer belt 4*a*. After that, the fixing device 5 fixes the transferred toner image on the recording medium 2 by heating.

The fixing device 5 is provided with a fixing roller 5*a* for applying heat onto the recording medium 2 and a pressure roller 5*b* for pressing the recording medium 2 on the fixing roller. These rollers have hollow cores in which heaters (not shown) are provided respectively. The rollers are driven to rotate so as to feed the recording medium 2.

In other words, the recording medium 2 with the toner image carried thereon is fed by the fixing roller 5*a* and the pressure roller 5*b* while applying heat and pressure to fix the toner image onto the recording medium 2. Then the recording medium 2 after being fixed is discharged by discharging rollers 3*h* and 3*j*, and stacked on a tray 6 of the apparatus main body 100.

(Mounting of Process Cartridge and Toner Replenishing Container)

Referring next to FIGS. 16 through 20, a description will be made about how to mount the process cartridges 90Y to 90K and the toner replenishing contains 120Y to 120K.

Figure 20:
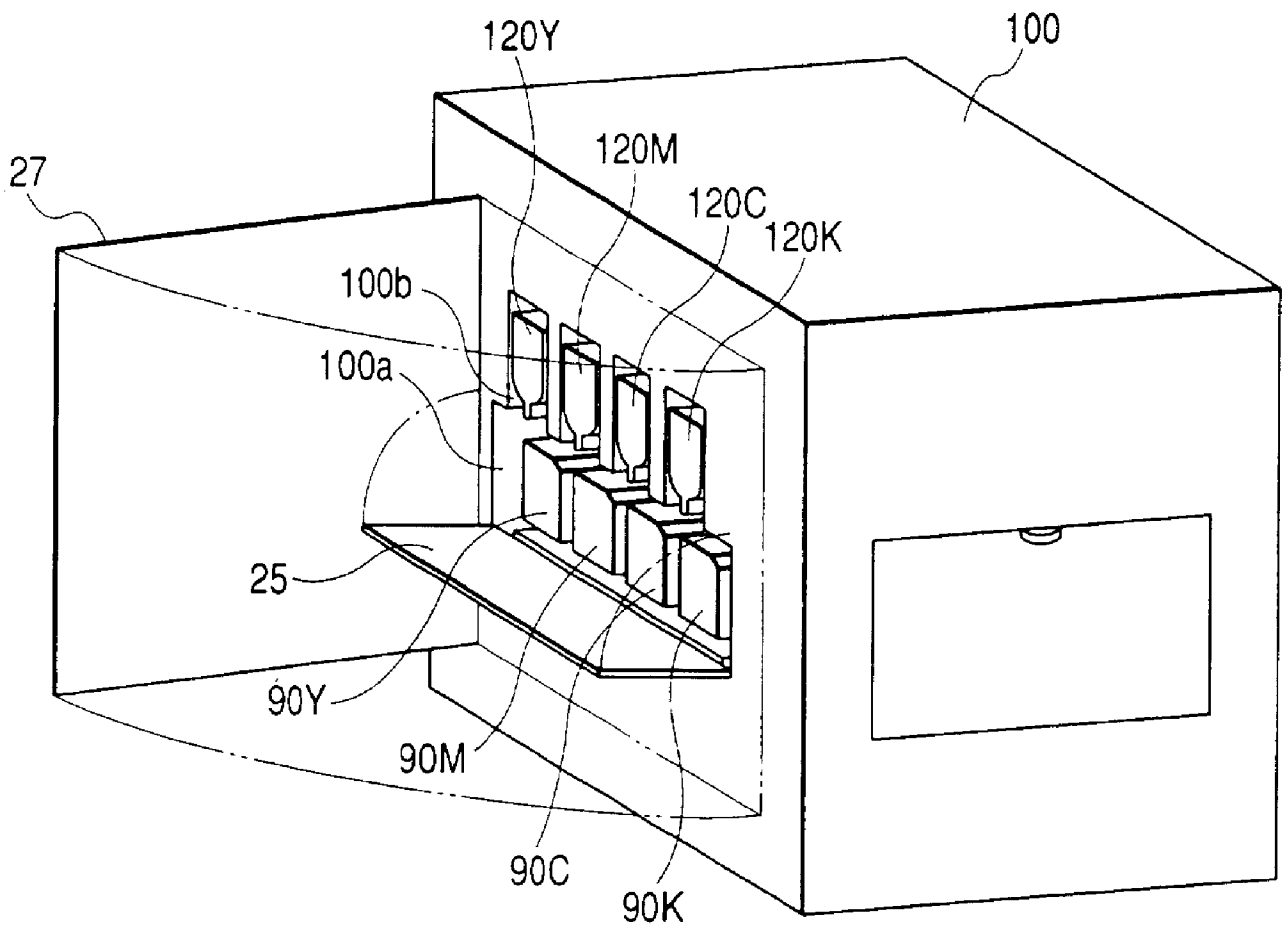
FIG. 20 is a perspective view showing the appearance of the color laser printer.

In FIG. 20, a door 27 capable of opening and closing is arranged on the front side of the apparatus main body 100. When the door 27 is opened forward, an opening is so exposed that the process cartridges 90Y to 90K and the toner replenishing containers 120Y to 120K can be inserted therefrom.

A centering plate 25 is arranged and rotatably supported in the opening part from which the process cartridges 90Y to 90K are inserted. The process cartridges 90Y to 90K are put in and out after opening and closing the centering plate 25.

In FIG. 16, guide rails 21 for guiding the respective process cartridges 90Y to 90K and guide rails 20 for guiding the respective toner replenishing containers 120Y to 120K are fixed inside the apparatus main body 100.

Since the process cartridges 90Y to 90K and the toner replenishing containers 120Y to 120K are mounted in a direction parallel with the axial direction of the photosensitive drum 7, the guide rails 21 and 20 are also arranged in the same direction. The process cartridges 90Y to 90K and the toner replenishing containers 120Y to 120K are slid along the respective guide rails 21 and 20, and inserted into the apparatus main body 100 from the front to the back.

When the process cartridges 90Y to 90K are inserted into the backmost part, the back end of the drum shaft 7*a* is inserted into a centering shaft 26 of the apparatus main body 100, and the center of rotation on the back side of the photosensitive drum 7 is placed in position. At the same time, the drum flange 7*b* and the driving coupling (convex part) 24 are so coupled that the photosensitive drum 7 can be driven to rotate.

Further, a support pin 22 for positioning each of the process cartridges 90Y to 90K is arranged on a back plate 23. The support pin 22 is inserted into the frame of each of the process cartridges 90Y to 90K to fix the position of the frame of the process cartridge.

The rotatable centering plate 25 is arranged on the front side of the apparatus body 100, and the bearing case 7*c* of each of the process cartridges 90Y to 90K is supported by and fixed to the centering plate 25. The above-mentioned sequence of inserting operations allow the photosensitive drum 7 and the process cartridges 90Y to 90K to be positioned relative to the apparatus main body 100.

On the other hand, as shown in FIGS. 17 and 18, when the toner replenishing containers 120Y to 120K are inserted into the backmost part, each of the toner replenishing containers 120Y to 120K is fixed by the corresponding support pin 22 that projects from the back plate 23. At the same time, the driving coupling (concave part) 12*e* and the driving coupling (convex part) 24 are so coupled that the screw 12*a* and the stirring shaft 12*c* can be driven to rotate.

Further, a positioning plate 19 is provided on a front plate 29. A shaft 19*a* of the positioning plate 19 is fit into a hole 15*a* of a holder 15 arranged on the front side of each of the toner replenishing containers 120Y to 120K. Thus the front side of each of the toner replenishing containers 120Y to 120K is placed in position.

(Storage Medium)

The following describes a storage medium.

The storage medium can be any type as long as it can store and hold rewritable signal information. For example, an electrical storage means such as a RAM or a rewritable ROM, and a magnetic storage means such as a magnetic recording medium, a magnetic bubble memory or a magneto-optical memory can be used.

(Electrical Configuration of System)

The following describes an electrical configuration of the system according to the present invention.

FIG. 1 is a block diagram showing a radio frequency IC memory unit 400 as the storage medium and a communication control part 410. This embodiment uses a ferroelectric nonvolatile memory (FeRAM 403) as the radio frequency IC memory.

(Toner Replenishing Container)

The radio frequency IC memory unit 400 is composed of an IC 404 and an antenna coil 401 that causes electromagnetic induction.

The radio frequency IC memory unit 400 is such that electromagnetic waves transmitted from a communication control board 410 provides power for the IC 404. Although the radio frequency IC memory unit 400 exchanges communication data with the apparatus main body 100, it can communicate with the apparatus main body 100 without the need to provide a power supply and electrical contacts on the side of the toner replenishing containers 120Y to 120K.

The IC 404 includes a modem circuit part 402 that demodulates data modulated at the time of reception and modulates the demodulated data at the time of transmission. The IC 404 also includes the FeRAM 403 (hereinbelow, called the RAM 403) for storing predetermined data.

(First Storage Part/Second Storage Part)

The RAM 403 is a rewritable memory; it is broadly divided into two storage areas 403*a* and 403*b*.

In FIG. 1, data (identification information) written by the manufacturer or vender but protected from being rewritten on the apparatus main body side 100 of the image forming apparatus are stored in the first storage area 403*a*. Such data or identification information may contain ID data on the toner replenishing containers 120Y to 120K, life threshold data, correction constants for use in calculating the utilization amount, driving control threshold data, quality control data, merchandise management data, and so on.

The ID data contain identification codes of the toner replenishing containers 120Y to 120K, a model-specific code, a maker code (such as OEM), a checksum, and the like.

The life threshold data may contain thresholds indicative of "Toner Out," "Toner Low 2," "Toner Low 1," and so on.

The correction constants include toner correction constant based on the kind of toner, a humidity correction constant based on variations in humidity of the toner, a utilization amount correction constant based on the utilization amount of the toner, a driving amount correction constant based on the driving amount of the screw 12*a*, and a part history correction constant based on the parts constituting the developer replenishing container.

The driving control threshold data may contain a threshold for varying the driving amount at the end of its life.

The quality control data contain the date of manufacture, the kind of toner, the filling amount of toner, the number of times the toner can be reused, and so on.

The merchandise management data contain the name, address and E-mail address (E-mail and/or http) of the vender, etc.

The second storage area 403*b* is an area rewritable on the apparatus main body side 100. For example, data on the utilization amount, error code data used when an abnormal condition occurs, the date of starting the use of the toner replenishing container, the date of ending the use of the toner replenishing container, and so on are stored in the second storage area 403*b*.

Information on the parts other than the toner replenishing containers 120Y to 120K, such as lot information of the apparatus main body 100, the number of jams of the apparatus main body 100 and the number of sheets used, can also be stored in the second storage area 403*b*.

(Image Forming Apparatus Main Body)

In FIG. 1, the apparatus main body side 100 includes the communication control board 410, an engine controller 420, a toner replenishing driving part 430 and a communication control board 440.

The communication control boards 410 and 440 are each provided with an antenna coil 411, a modem circuit part 412, a communication control circuit part 413 and a resonance circuit part 414.

The communication control circuit part 413 is connected to a CPU 421 of the engine controller 442 for communicating with the engine controller 442.

The toner replenishing driving part 430 is provided with a driving amount detection part 431 for detecting the driving amount of a toner replenishing driving motor, and the toner replenishing driving motor 432.

(Process Cartridge)

The process cartridges 90Y to 90K are each provided with a radio frequency IC memory unit 450 having the same structure as the IC 404, and the toner density detecting part 10*g*.

(Toner Remaining Amount Detecting Mechanism)

The following describes a mechanism for detecting the remaining amount of toner.

Basically, the mechanism can be any known mechanism as long as it can detect that the remaining amount of toner is equal to or lower than a predetermined value.

For example, the mechanism can be used to detect the capacitance of toner, detect the weight of toner, detect the presence or displacement of toner from its light reflectivity or transmittance, or detect the presence of toner by means of a piezo element.

In the embodiment, the remaining amount of toner is detected from the driving amount of the toner replenishing means.

The indication of the driving amount may be either direct or indirect.

Events that directly indicate the driving amount are, for example, rotating time of the driving shaft, the number of revolutions, and the distance traveled by the total number of revolutions. One of the methods for detecting the driving amount uses a rotary flag having two or more notches or slits arranged around the driving shaft so that ON and OFF timings or the number of times of transmissions of light passing through the notches of the rotary flag can be detected. Various known encoders may also be used.

If the distance traveled by the total number of revolutions is to be detected, a laser Doppler velocimeter may be used.

Events that indirectly indicate the driving amount may be parameters for use in controlling the driving motor for the toner replenishing means. For example, if the driving motor is a pulse motor, the number of input pulses can decide on the driving amount. If the driving motor is a DC servo motor, input voltage and input time can control the driving amount.

This embodiment uses an inexpensive DC motor. Although it is cheap, the DC motor tends to vary its driving amount depending on the load thereon. In other words, since the driving amount varies due to load variations even at fixed driving time intervals, control using the driving time cannot decide on an accurate driving amount.

A control circuit for making the DC motor run at a fixed speed can be provided to prevent the above-mentioned variations, but such a control circuit increases apparatus cost.

Therefore, in the embodiment, a rotary flag 32 is arranged around the rotating shaft of the toner replenishing driving part as shown in FIG. 18. In this case, projections and depressions of slits are counted by a flag sensor so that the number of counts will be processed as the driving amount.

It should be noted that the rotary flag 32 may be arranged either on the side of each of the toner replenishing containers 120Y to 120K or in the toner replenishing driving part of the apparatus main body 100.

The above-mentioned screw 12*a* has the ability to discharge about 250 to 270 mg of toner per rotation. Since each of the toner replenishing containers 120Y to 120K stores about 530 g of toner, the remaining amount of toner will be nearly zero after about 2,000 rotations of the screw 12*a*.

In the embodiment, the relationship between rotational speed (rpm) of the rotary flag shaft and the rotational speed (rpm) of the screw 12*a* shows an integral ratio of 3:1. Further, the slits are divided into eight by the projections and depressions. Therefore, if ON or OFF of one slit is one count, the remaining amount of toner will be nearly zero after about 4,800 counts.

(System Operation)

Referring to FIGS. 1 through 13, the operation of the system will be described below.

(Sequence of Toner Replenishment/Toner Remaining Amount Detection)

Referring next to FIGS. 2 to 7 and 8 to 13, a description will be made about a sequence of toner replenishing processing and a sequence of toner remaining amount detecting processing according to the present invention.

Figure 2:
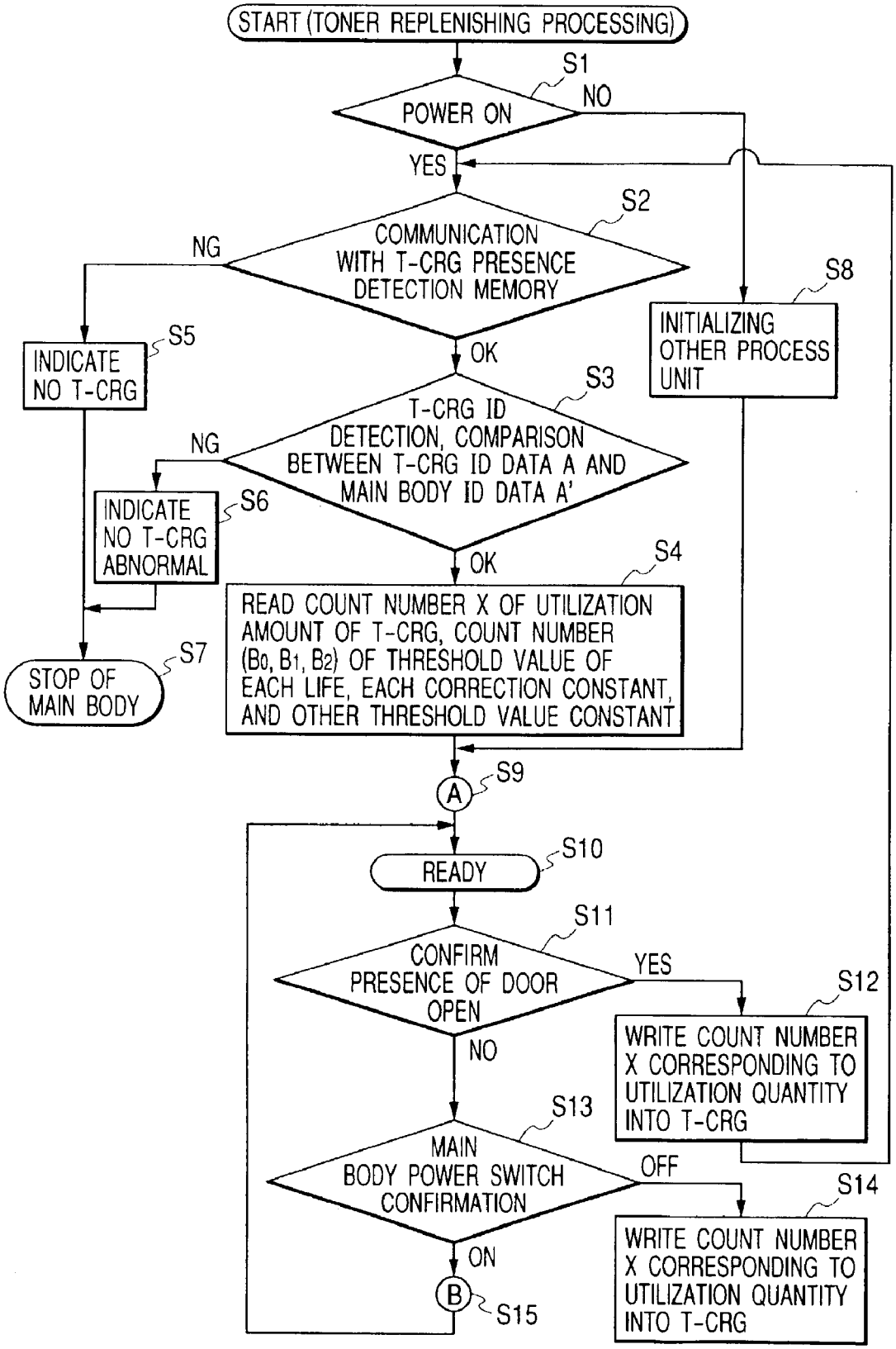
FIG. 2 is a flowchart showing toner replenishing processing.

FIG. 2 is a flowchart showing a general flow of toner replenishing processing according to the present invention.

(Presence or Absence of Toner Replenishing Container)

(1) At first, it is confirmed in step S1 whether the power source of the apparatus main body 100 is ON. If the power source is ON, the operating procedure goes to step S2. If the power source is not ON, it goes to step S8 in which other process units are initialized.

In step S2, the, presence or absence of the toner replenishing containers (T-CRG) 120Y, 120M, 120C and 120K in the apparatus main body 100 is detected.

As shown in FIG. 1, the presence of the T-CRG is detected by the radio frequency IC memory unit 400 responding to predetermined resonance frequency transmitted from the communication control board 410.

If predetermined ID data as identification information stored in the first storage area 403*a* of the RAM 403 is transmitted through the modem circuit part 402 of the radio frequency IC memory unit 400, it is judged that the toner replenishing containers 120Y to 120K exist. Then the operating procedure goes to step S3.

On the other hand, if there is no response, it is judged that the toner replenishing containers 120Y to 120K have not been mounted yet, and the operating procedure goes to step S5 in which it is informed that there is no toner replenishing containers 120Y to 120K. After that, it goes to step S7 in which the operation of the apparatus main body 100 is stopped.

To be specific, the presence or absence of the toner replenishing containers 120Y to 120K is confirmed through communication between the radio frequency IC memory unit 400 and the communication control board 410 mounted in the image forming apparatus.

(Confirmation of ID)

(2) Next, in step S3, the ID data (data A) as the identification information on the toner replenishing containers 120Y to 120K are compared with ID data (data A') stored in the memory of the apparatus main body 100.

If the data A accord with the ID data (data A') stored in the memory of the apparatus main body 100, the operating procedure goes to step S4.

On the other hand, if the data A disaccord with the ID data (data A') stored in the memory of the apparatus main body 100, the operating procedure goes to step S6 in which it is informed that an abnormal condition occurs to the toner replenishing containers 120Y to 120K. After that, in step S7, the operation of the apparatus main body 100 is stopped.

For example, as such an abnormal condition, there is a case where toner replenishing containers the colors of which are different from the colors specified. In this case, a message for instructing the user to mount toner replenishing containers 120Y to 120K for proper colors in position.

Further, toner replenishing containers 120Y to 120K with the same appearance but different contents might be manufactured. If even one of such toner replenishing containers exists together with proper toner replenishing containers, the image forming apparatus cannot perform properly, and a defective image may be caused.

For example, it is considered that the composition of toner is changed to change the pigment, or that the melting point of toner is changed. An expected color tone cannot be achieved unless four colors of toner have the same composition. Further, if the melting point of toner varies in color, fixing characteristics may be worsened.

The above-mentioned problems can be prevented by confirming the ID data attached to each of the toner replenishing containers 120Y to 120K.

(Confirmation of Total Utilization Amount of Toner)

(3) Next, in step S4, the utilization amount of each of the toner replenishing containers 120Y to 120K is confirmed to judge whether the toner replenishing container 120Y-120K mounted can replenish toner.

The total utilization amount X is stored in the second storage area 403*b* of each of the toner replenishing containers 120Y to 120K. In this embodiment, the above-mentioned count number is used.

In addition to the total utilization amount X, count numbers ($B_0$, $B_1$, $B_2$) as threshold data on each life, various other correction constants, threshold coefficients, and the like are read. In the embodiment, the count numbers are used as the life threshold data.

Figure 3:
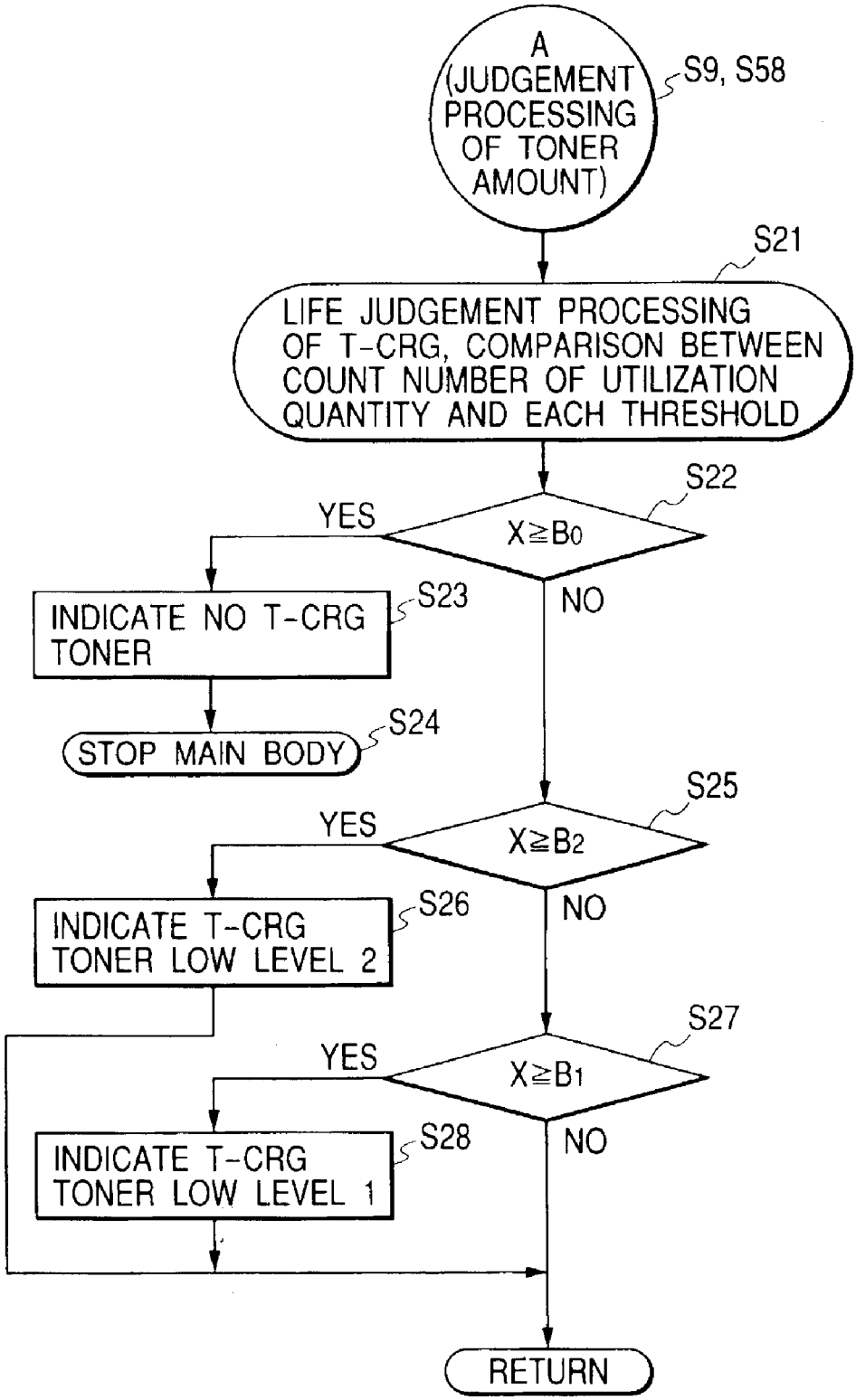
FIG. 3 is a flowchart showing judgment processing of a toner amount.

After that, the operating procedure goes to step S9 in FIG. 3 to check the amount of toner.

(Judgment Processing of Toner Amount)

FIG. 3 is a flowchart showing judgment processing of a toner amount.

(4) In step S21, each of the life threshold data ($B_0$, $B_1$, $B_2$) is compared with the utilization amount X stored.

In step S22, if $X \geqq B_0$, the operating procedure goes to step S23 in which "Toner Out" is displayed for corresponding one of the toner replenishing containers 120Y to 120K is displayed. Then, in step S24, the operation of the apparatus main body 100 is stopped.

In this case, a message for informing the user that the toner replenishing container 120Y-120K is at the end of its life and needs replacing is displayed on an operation panel of the apparatus main body 100 or a host (such as a computer) from which printing is instructed.

In step S25, if $X \geqq B_2$, the operating procedure goes to step S26 in which "Toner Low Level 2" of the toner replenishing container 120Y-120K is informed.

In this case, a message for informing the user that the life of the toner replenishing container 120Y-120K is approaching the end of its life cycle and the container needs replacing is displayed on the operation panel of the apparatus main body 100 or the host (such as a computer) from which printing is instructed.

In step S27, if $X \geqq B_1$, the operating procedure goes to step S28 in which "Toner Low Level 1" of the toner replenishing container 120Y-120K is informed.

In this case, a message for informing the user that the toner replenishing container 120Y-120K is low on toner and needs attention is displayed on the operation panel of the apparatus main body 100 or the host (such as a computer) from which printing is instructed.

(Stop of Apparatus Main Body)

It is judged in step S22 that the toner replenishing container 120Y-120K is at the end of its life, the operating procedure goes to step S24 in which the operation of the apparatus main body 100 is stopped. The following describes the reason why the apparatus main body 100 needs stopping.

As discussed above, the developer in the developer storage part 10*h* of the developing device 10 is mostly made of magnetic carrier, and the toner contained therein is only 8%. It corresponds to about 13 to 14 g in weight.

To ensure creation of proper images, the toner amount must be controlled within a proper range. In the embodiment, such a variation in the amount of toner as to exceed ±2.6 g is considered to be in danger of causing nonuniform images or other abnormal images.

To minimize such a variation, the inductance sensor 10*g* detects the density of toner so that toner can be replenished to make up for the shortage.

If the toner replenishing container 120Y-120K runs out of toner, or a required amount of toner cannot be replenished, toner will be consumed fast from the developer storage part 10*h*. As a result, the toner runs out in the end; besides, the magnetic carrier runs the danger of partially separating from the developer.

The separation of the magnetic carrier from the developer causes extensive damage to the image forming apparatus. The magnetic carrier is made of iron powder and its surface is so hard that it could scratch the soft surface of the intermediate transfer belt 4*a*.

Further, if the magnetic carrier flies off and falls downstream of the intermediate transfer belt 4*a*, the interior of the apparatus main body 100 will become contaminated, which in turn runs the danger of causing damage to the other units.

Furthermore, once the magnetic carrier has separated from the developer, since it cannot be replenished, the cartridge cannot live out its usable life.

Therefore, in the embodiment the operation of the apparatus main body 100 is stopped as soon as the life of each toner replenishing container 120Y-120K expires, thereby preventing the above-mentioned problems.

After that, the operating procedure returns to the flowchart of FIG. 2, and a sequence of operations from step S10 are executed. In other words, if the amount of residual toner in each of the toner replenishing containers 120Y to 120K is not zero, that is, if $X<B_0$, the apparatus main body 100 operates and becomes a ready state.

In step S11, it is confirmed whether the door is open or closed. If the door is open, the operating procedure goes to step S12. If the door is closed, it goes to step S13.

In step S12, the count number of the total utilization amount X is written into the second storage area 403*b* of each toner replenishing container 120Y-120K.

In step S13, it is conformed whether the power source of the apparatus main body 100 is switched ON or OFF. IF the switch is OFF, the operating procedure goes to step S14 in which the count number of the total utilization amount X is written into the second storage area 403*b* of each toner replenishing container 120Y-120K in the same manner as in step S12.

If the switch is ON, the operating procedure goes to step S15 to execute image forming processing.

(Image Forming Processing)

Figure 4:
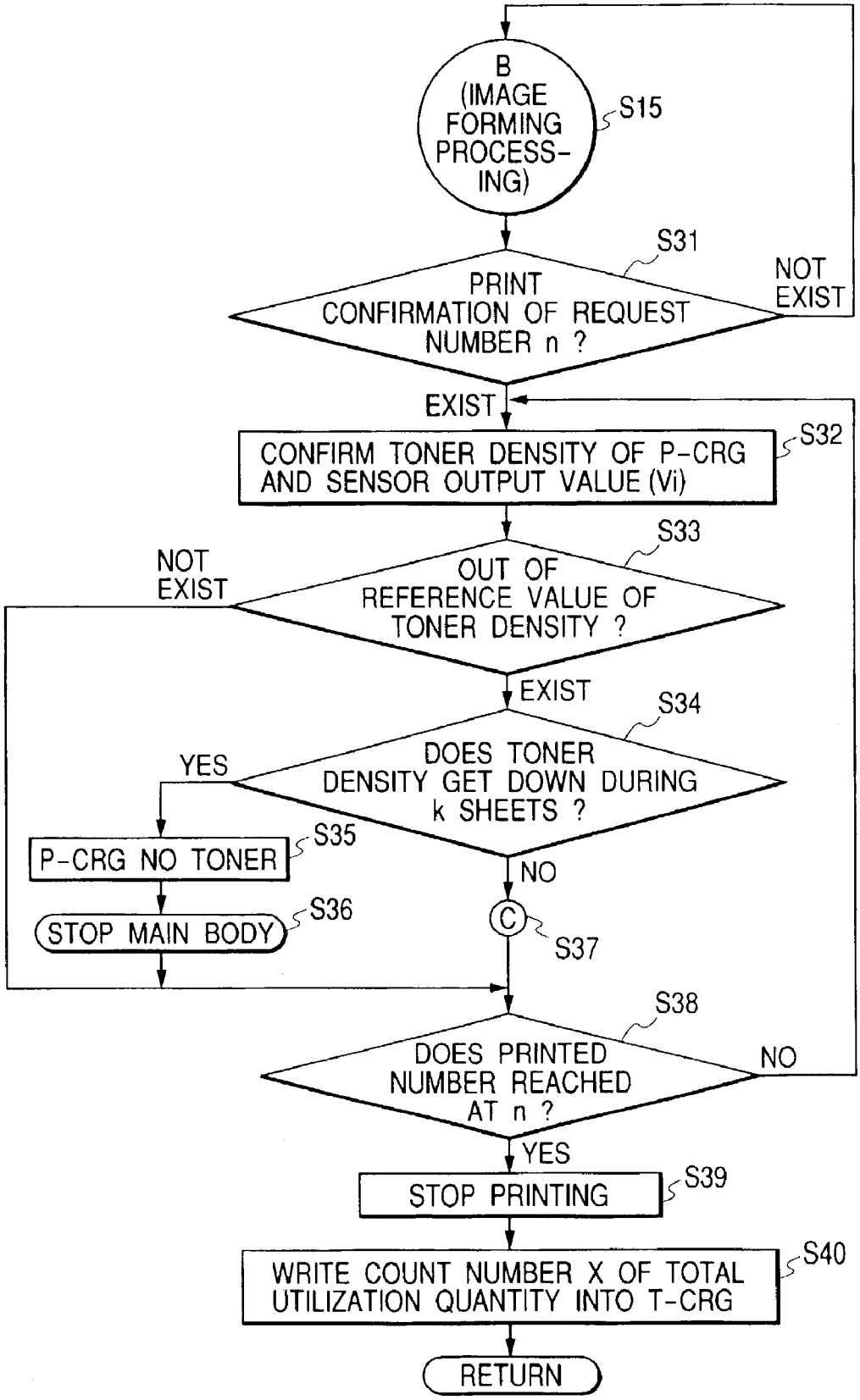
FIG. 4 is a flowchart showing image forming processing.

FIG. 4 is a flowchart showing image forming processing.

(5) In step S31, a printing request is confirmed and if the printing request is received, the operating procedure goes to step S32.

In step 32, predetermined image forming operation is started, and the inductance sensor 10*g* attached to each of the process cartridges 90Y to 90K as shown in FIG. 1 sends an output signal $V_i$ to the CPU 421 of the apparatus main body 100.

The CPU 421 confirms the output signal $V_i$, and the operating procedure goes to step S33 in which it is confirmed whether the density of toner is out of a reference value.

If it is judged that the density of toner is out of the reference value and it is too low, the operating procedure goes to step S34 in which it is checked whether the density of toner gets down during K sheets.

If the density of toner does not get down, the operating procedure goes to step S37. In step S37, decision processing of the feed amount of the toner discharging part of each of the toner replenishing containers 120Y to 120K is executed.

On the other hand, if the density of toner gets down, the operating procedure goes to step S35. Then, no toner is displayed in step S35, and the operation of the apparatus main body 100 is stopped in step S36.

If it is confirmed in step S33 that the density of toner is not out of the reference value, the operating procedure goes to step S38.

In step S38, it is checked whether the number of printed sheets has reached n. If it has reached n, the operating procedure goes to step S39. If it has not reached n, it returns to step S32.

In step S39, printing operation is stopped, and in step S40, the count number of the total utilization amount x is written into the second storage area 403*b* of each of the toner replenishing containers 120Y to 120K.

(Decision Processing of Feed Amount)

The following describes the decision processing of the feed amount executed in step S37.

Figure 5:
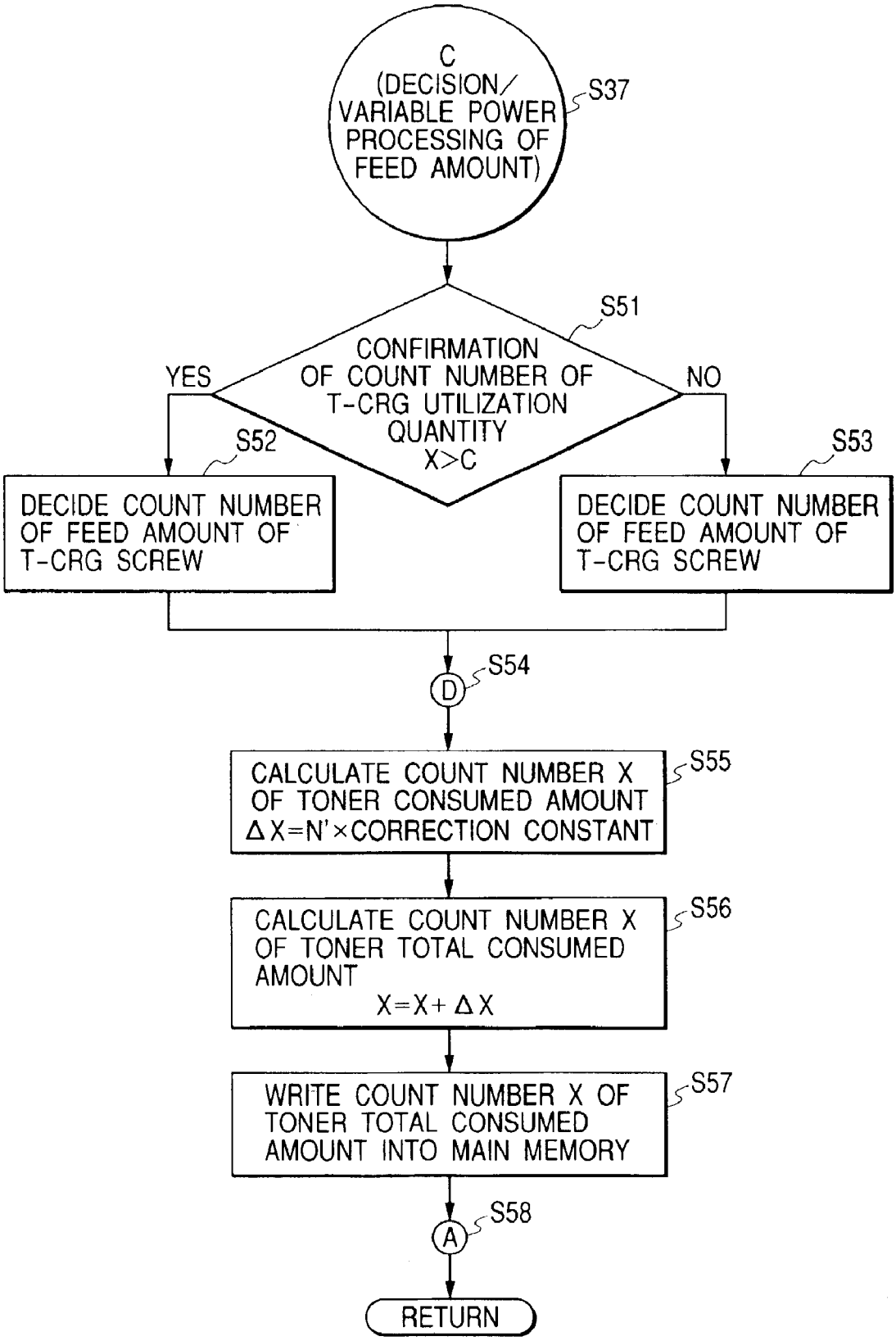
FIG. 5 is a flowchart showing decision processing (variable power processing) of a feed amount.

FIG. 5 is a flowchart showing the decision processing of the feed amount.

In step S51, it is judged whether the count number of the total utilization amount X of each of the toner replenishing containers 120Y to 120K is larger than a predetermined value C. If it is judged that X is larger than the predetermined value C, the operating procedure goes to step S52. If not larger, it goes to step S53.

In step S52, since X>C, the count number of the feed amount of each of the toner replenishing containers 120Y to 120K is increased by a factor of D. On the other hand, in step S53, since X<C, the count number is not changed.

In the embodiment, the output signal $V_i$ from the inductance sensor 10*g* in each of the process cartridges 90Y to 90K is in a range of 0 to 5V. In this range, an output signal of 2.5V indicates that the density of toner is optimal. If the density of toner is lower, the output signal becomes higher than 2.5 V, while if the density of toner is higher, the output signal becomes lower than 2.5 V.

The output signal $V_i$ is referred to a predetermined table (in which 5V is divided into 256 in increments of 0.02V), and stored in the memory of the apparatus main body 100 as values in hexadecimal from 0h to FFh by setting a value for inductance control voltage to 1. For example, if the output signal $V_i$ is 2.5V, it becomes 80h, while if $V_i$ is 2.58V, it becomes 84h.

In the embodiment, a change in toner density with a change of 0.02V in the output signal $V_i$ corresponds to a toner amount of about 64 mg.

For example, if the output signal $V_i$ is 2.58V, since it has a difference of 0.08V from the center value of 2.5V, it is considered that about 260 mg of toner is reduced.

Such a reduced amount of toner needs replenishing. In the embodiment, the amount of toner of about 260 mg corresponds to the amount of toner discharged during one rotation of the screw 12*a*, which in turn corresponds to a count number of 24 counted by the rotary flag 32.

In other words, the feed amount N is determined from the following equation:

$$N=(V_i-2.5)/0.02/4\times8\times3=(V_i-2.5)\times300 \quad (1)$$

(Variable Power Control of Feed Amount)

(6) The following describes variable power control processing of the feed amount.

In the embodiment, such driving control as to multiply the feed amount by a variable at the end of the life is performed to reduce the amount of residual toner remaining inside each of the toner replenishing containers 120Y to 120K as much as possible. To be specific, the count number of the feed amount is increased by a factor of between 5 and 20.

In the embodiment, input voltage of the DC motor is kept constant (at 24V), but the input voltage may be so increased that the motor speeds up. If a pulse motor is used, the number of pulses is multiplied by a certain number, while if a DC servo motor is used, the driving time is multiplied by a certain number.

Figure 10:
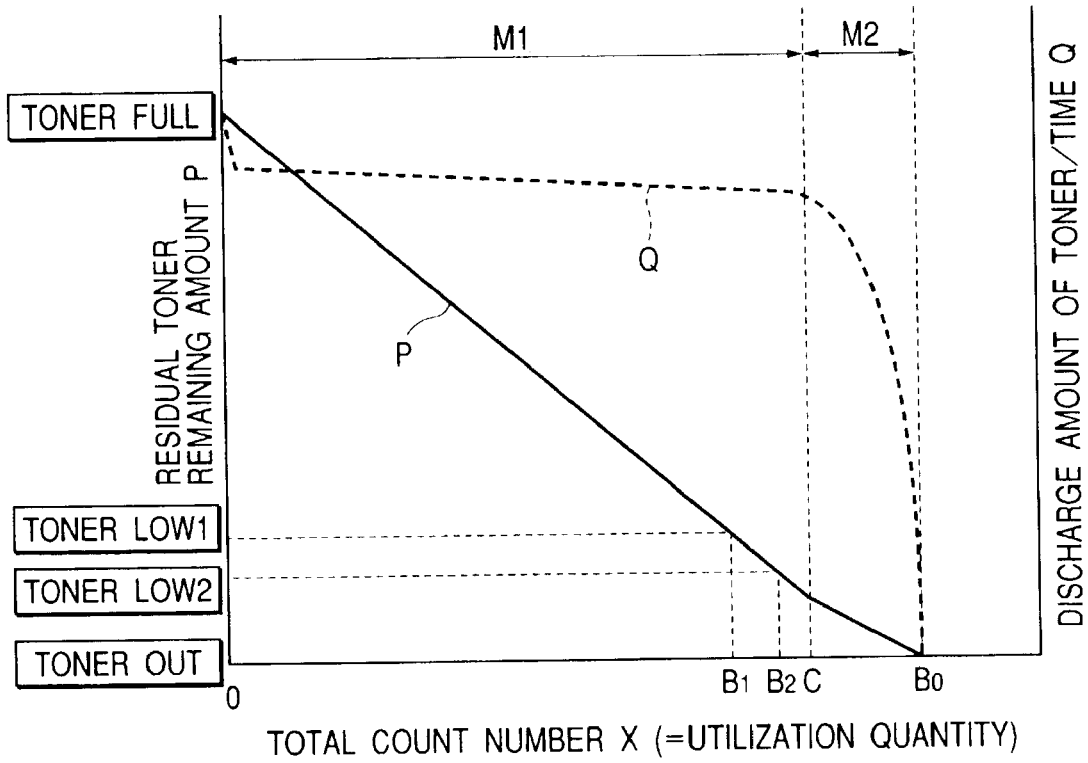
FIG. 10 is a graph showing characteristics of the remaining amount of toner and the discharge amount of toner in relation to the number of counts.
Figure 11:
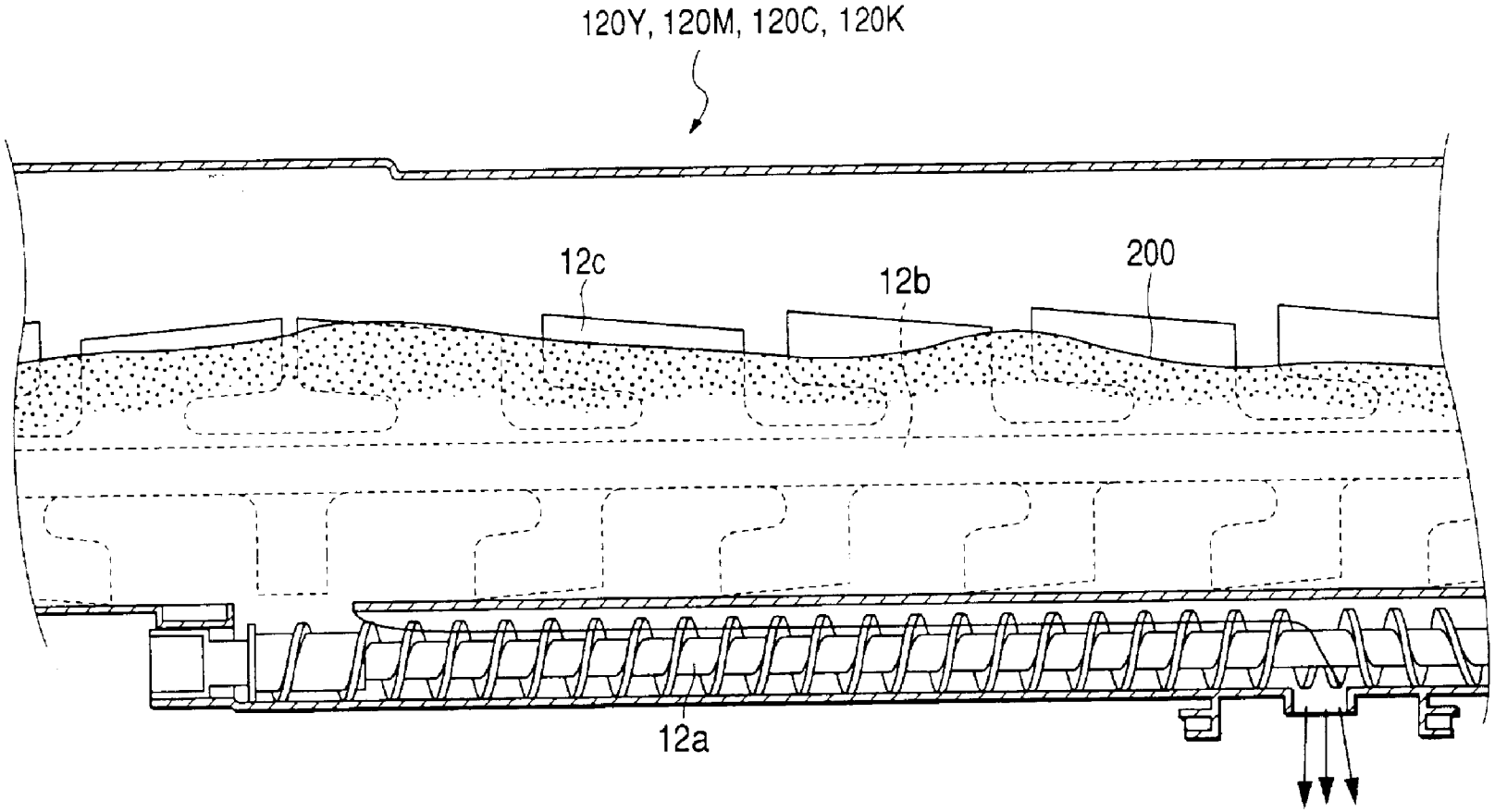
FIG. 11 is a diagram for explaining variations in toner amount remaining in the toner replenishing container.
Figure 12:
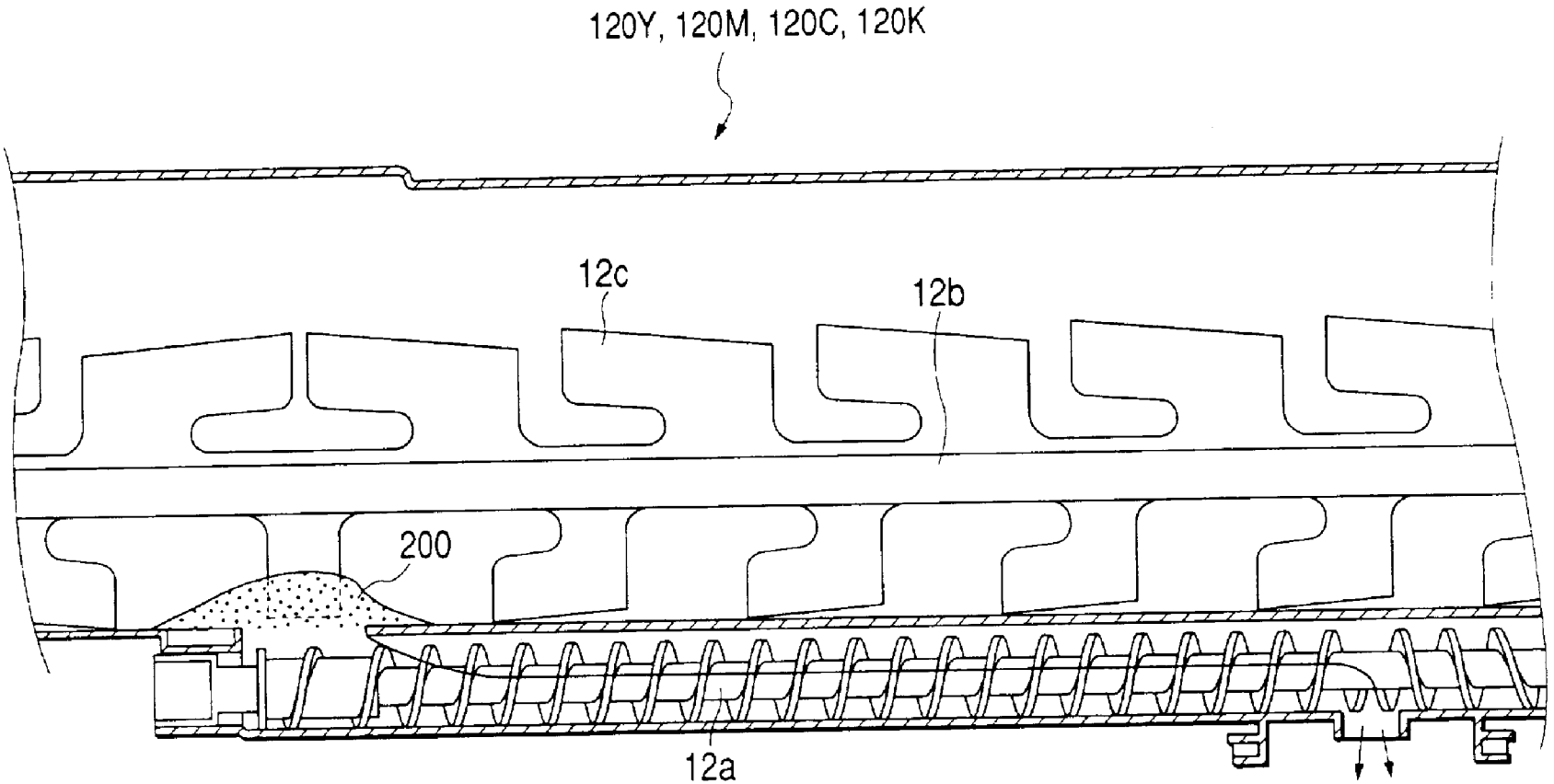
FIG. 12 is a diagram for explaining a toner replenishing operation.

Referring next to FIGS. 10 to 12, a description will be made about the reason why such driving control is needed.

FIG. 10 shows the total count number X when the toner amount and the total amount of toner consumed are chosen as the ordinate and abscissa, respectively. Indicated here as toner amounts are residual toner remaining amount P and discharge amount of toner/time Q.

The discharge amount of toner/time Q is stable in a range of M1 except in early stages of using, but it suddenly decreases in a range of M2. As shown in FIG. 11, the toner storage part of each of the toner replenishing containers 120Y to 120K stores a sufficient amount of toner in the range of M1. In this condition, since toner is supplied from the stirring plates 12*b* to the screw 12*a* constantly and stably, the discharge amount of toner is also stable.

In contrast, in the range of M2, toner in the toner storage part of each of the toner replenishing containers 120Y to 120K is getting low as shown in FIG. 12. In this case, the supply of toner from the stirring plates 12*b* to the screw 12*a* is considerably reduced.

In other words, most of the toner particles exist in the screw 12*a* at the end of the life of toner, and the total amount of toner existing in the screw 12*a* is also reduced compared to that in the stable condition. This is why the discharge amount of toner at the end of the life of toner is greatly reduced compared to that in the stable condition.

Thus the feed amount of the screw 12*a* needs increasing in order to discharge a required amount of toner at the end of its life. In the embodiment, such driving control as to multiply the feed amount of the toner discharging part by a certain number is performed.

The amount of driving control at the end of the life of toner is changed when the amount of residual toner is reduced to between 50 to 10 g. The feed amount is decided by referring to the utilization amount X of each of the toner replenishing containers 120Y to 120K.

To be more specific, a point of border C between the ranges M1 and M2 is defined by a predetermined count number for use in checking in step S51 as to whether X>C or not. If X>C, the operating procedure goes to step S52 in which the count number N of the feed amount is increased by a factor of D. If not X>C, the operating procedure goes to step S53 in which the count number N of the feed amount is not changed. After that, it goes to step S54 and the amount of toner consumed is calculated.

(Calculation of Amount of Toner Consumed)

Figure 6:
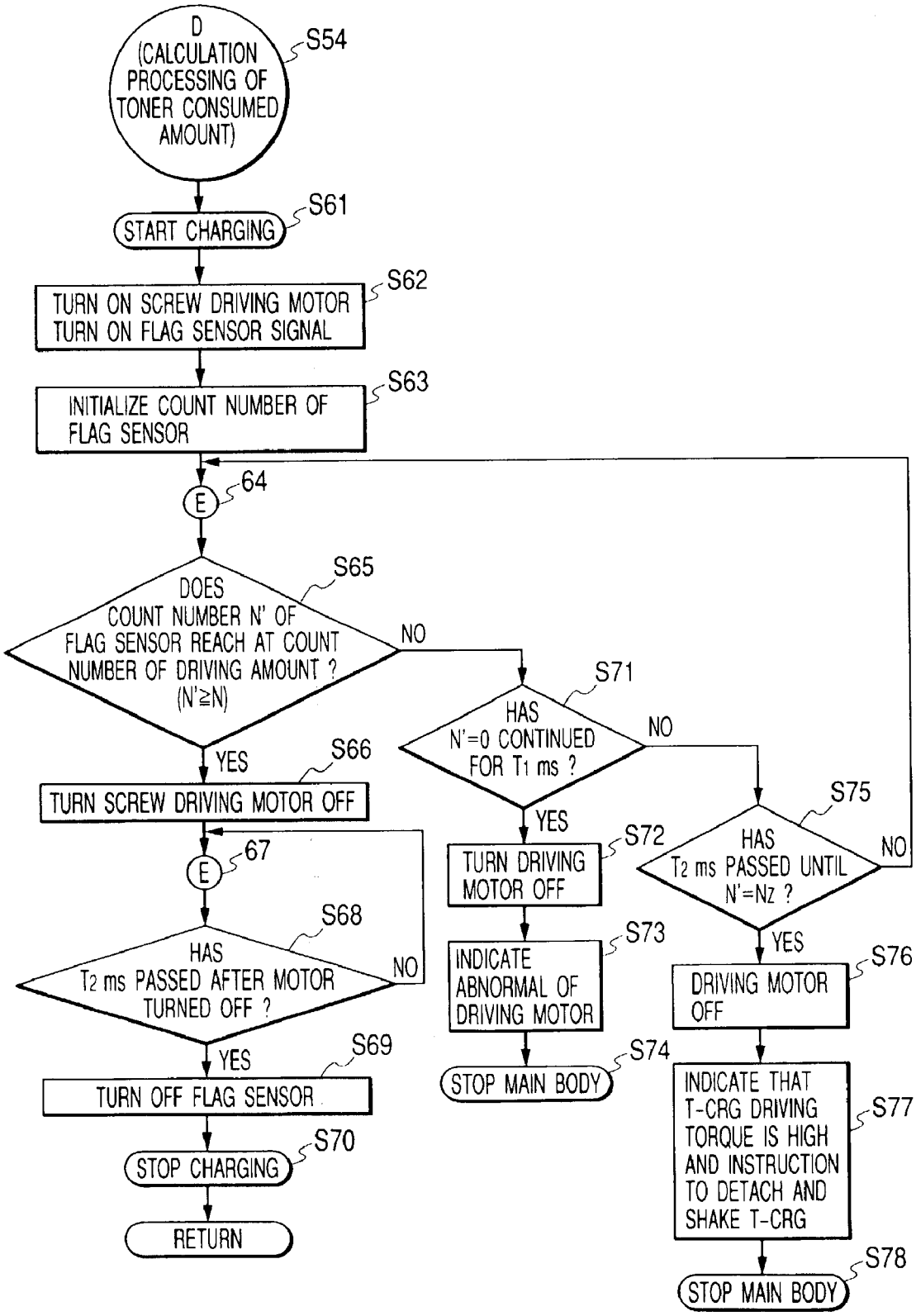
FIG. 6 is a flowchart showing calculation processing of a toner consumed amount.

FIG. 6 is a flowchart showing calculation processing of the amount of toner consumed.

Figure 8:
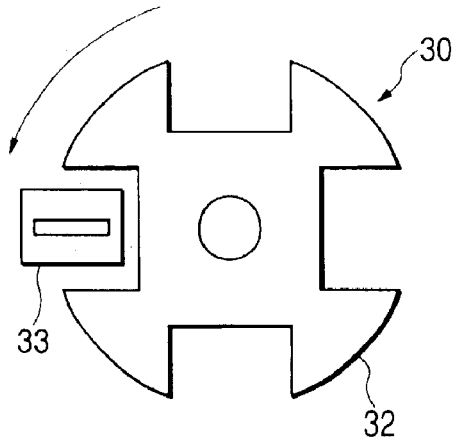
FIG. 8 is a side view showing a configuration of a feed amount detecting part.

(7) As shown in FIG. 8, the count detecting mechanism in the embodiment has the rotary flag 32 mounted around the driving shaft of the toner replenishing driving part 30, and eight projections and depressions are made by cutting four slits. The flag sensor 33 has its sensor surface arranged perpendicularly to the rotating direction of the rotary flag 32.

The flag sensor 33 is made up of a combination of a high-power infrared LED and a phototransistor, such that light emitted from the infrared LED is repeatedly received and intercepted by the projections and depressions of the slits of the rotary flag 32 as the rotary flag 32 rotates.

Figure 9:
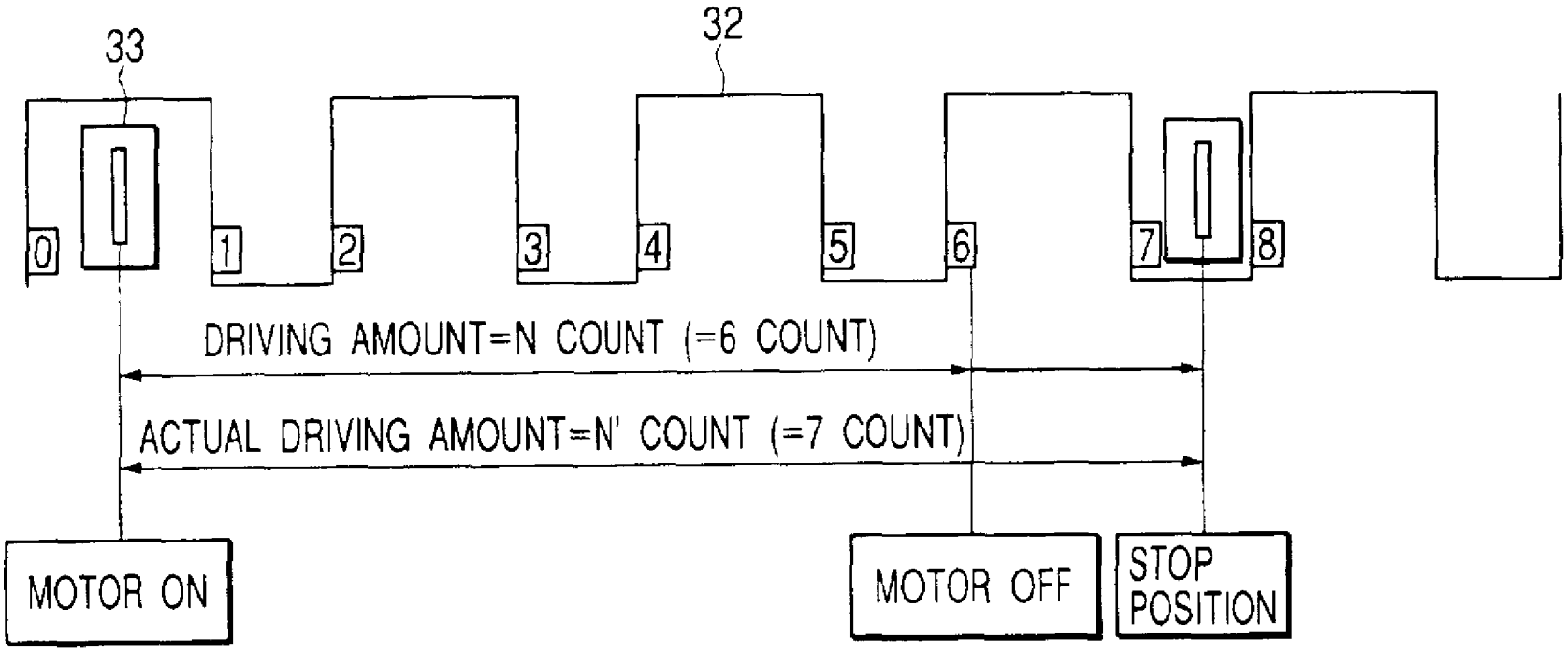
FIG. 9 is a diagram for explaining count processing of a feed amount.

As shown in FIG. 9, the output signal from the phototransistor becomes HIGH each time light from the infrared LED is intercepted, while a signal LOW is transmitted each time light from the infrared LED is received. Upon receipt of these output signals from the phototransistor, the CPU 24 counts the driving amount of the toner replenishing driving part 30.

Then, in step 61, a replenishing operation is started. In other words, the toner replenishing driving part 30 (see FIGS. 8 and 18) drives the screw 12*a* according to the feed amount decided in the previous processing.

In step S62, the driving motor 34 of the screw 12*a* (see FIG. 18) and the flag sensor 33 is turned on. In step 63, the count number N' of the flag sensor 33 is initialized (N'=0). Then, in step 64, count processing of the flag sensor 33 is started.

(Count Processing of Sensor)

Figure 7:
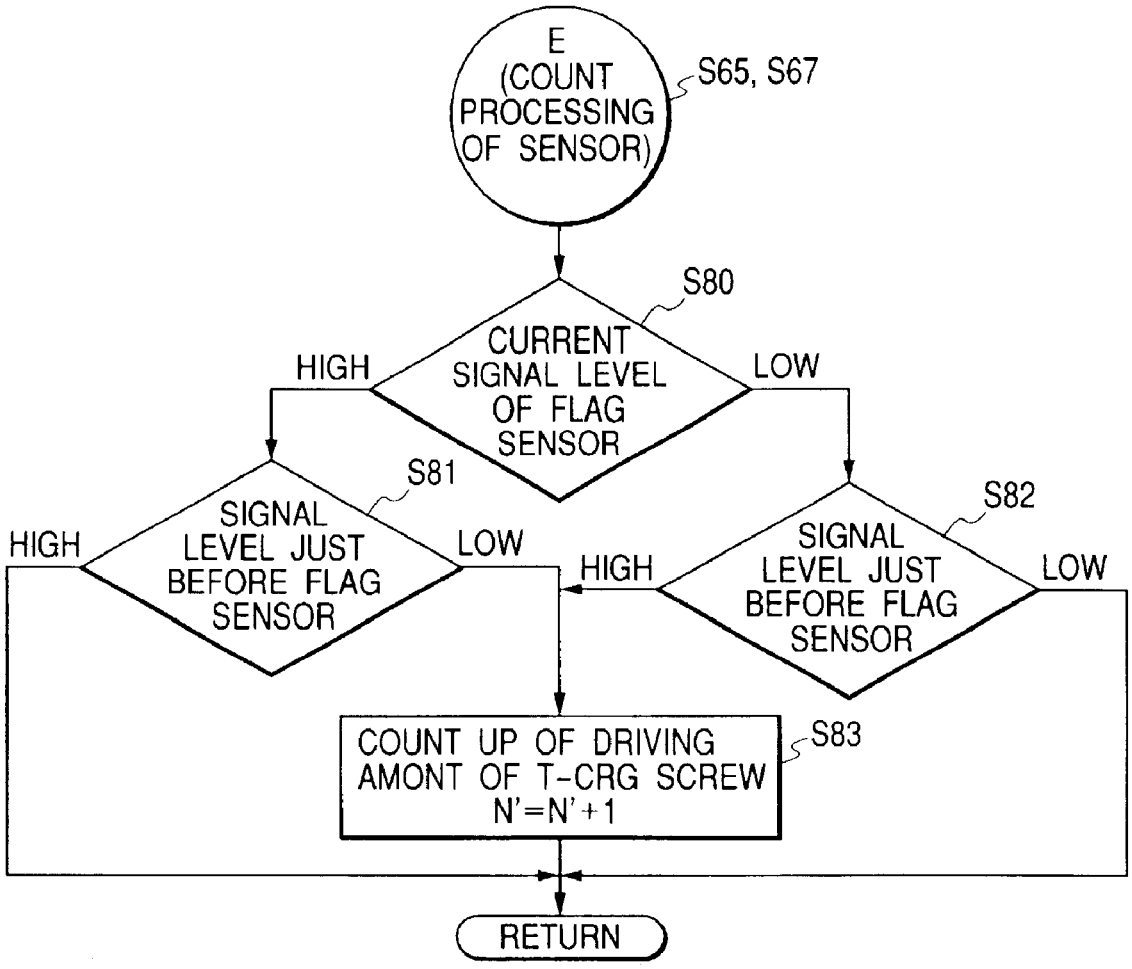
FIG. 7 is a flowchart showing count processing of a flag sensor.

FIG. 7 is a flowchart showing count processing of the flag sensor 33. The count processing is performed by counting ON and OFF of light transmitted through the slits of the rotary flag 32. The count number is used as the feed amount.

In step S80, the current signal level is checked. In the embodiment, the count number is incremented each time either a high level (HIGH) or a low level (LOW) is detected as the signal level. The operating procedure goes to step S81 if the high level is detected, while it goes to step S82 if the low level is detected.

In steps S81 and S82, the previous signal level is checked respectively.

If the signal level is low in step S81 and high in step S82, the operating procedure goes to step S83 in which the feed amount N' of the screw 12*a* in each of the toner replenishing containers 120Y to 120K is counted up or incremented. In this case, N'=N'+1.

If the signal level is high in step S81 and low in step S82, the operating procedure returns to step S65 in FIG. 6.

In step S65, it is checked whether the count number N' of the flag sensor 33 has reached the count number N of the feed amount.

If it has reached the predetermined count number since the driving motor 34 was turned on, the operating procedure goes to step S66 and the driving motor 34 is turned off.

Then it goes to step S67 to repeat the count processing of FIG. 7. After that, it is checked in step S68 whether a predetermined time period ($T_2$ ms) has passed since the motor was turned off. If the predetermined time period has passed, the operating procedure goes to step S69 in which the flag sensor 33 is turned off. Then, in step S70, the replenishing operation or charging is stopped.

The screw 12*a* starts or stops its rotation each time the driving motor 34 is turned on or off. However, the screw 12*a* cannot stop in the strict sense in synchronization with the timing of turning the driving motor 34 off.

The toner replenishing driving part 30 has a constant inertia force, which causes a delay in the timing of stopping the screw 12*a*. Especially, when the toner replenishing container 120Y-120K is a light load, that is, as the life of the toner replenishing container 120Y-120K expires, a braking force of the toner replenishing container 120Y-120K is reduced, which makes it hard to stop the screw 12*a* at that instant.

Variations in stopping position cause a difference between the driving amount and the actual driving amount, and an accumulation of differences makes it impossible to estimate an accurate remaining amount of toner.

To prevent this, the embodiment confirms the number of counts of the rotary flag 32 after turning the driving motor 34 off so that an actual driving amount N' will be detected.

In the embodiment, the rotation time of the driving shaft of the toner replenishing driving part 30 is detected to perform the following processing.

In step S65, if the count number of the flag sensor has reached the predetermined count number, the operating procedure goes to step S71. Then, it is checked in step S71 whether N'=0 (where N' is the count number of the flag sensor 33) has continued for a predetermined time period ($T_1$ ms).

If N'=0 has continued for the predetermined time period ($T_1$ ms) even after the driving motor 34 was turned on, it is judged that the driving motor 34 has broken, and the operating procedure goes to step S72 in which the driving motor 34 is turned off. Then, the abnormality or breakdown of the driving motor 34 is indicated in step S73, and the operation of the apparatus main body 100 is stopped in step S74.

On the other hand, if N'=0 has not continued for the predetermined time period ($T_1$ ms), the operating procedure goes to step S75. In step S75, it is checked whether time for the count number N' of the flag sensor 33 to reach a predetermined count number Nz has exceeded the time period of $T_2$ ms. If it has exceeded $T_2$ ms, it is judged that driving torque of the toner replenishing container 120Y-120K is high, and the operating procedure goes to step S76. If it has not exceeded $T_2$ ms, it returns to step S64.

In step S76, the driving motor 34 is turned off because of high driving torque. Then the operating procedure goes to step S77 in which it is instructed to detach and shake the toner replenishing container 120Y-120K. After that, in step S78, the operation of the apparatus main body 100 is stopped.

The DC motor is such that the driving load is inversely proportional to the rotational speed, and its current value increases on a proportional basis. Therefore, driving torque of the toner replenishing container 120Y-120K may be detected by monitoring the current value. Further, in the embodiment driving control is performed each time the screw 12*a* makes a turn, which makes it possible to reduce the variation in the amount of toner to be replenished while the screw 12*a* is making a turn.

Figure 13:
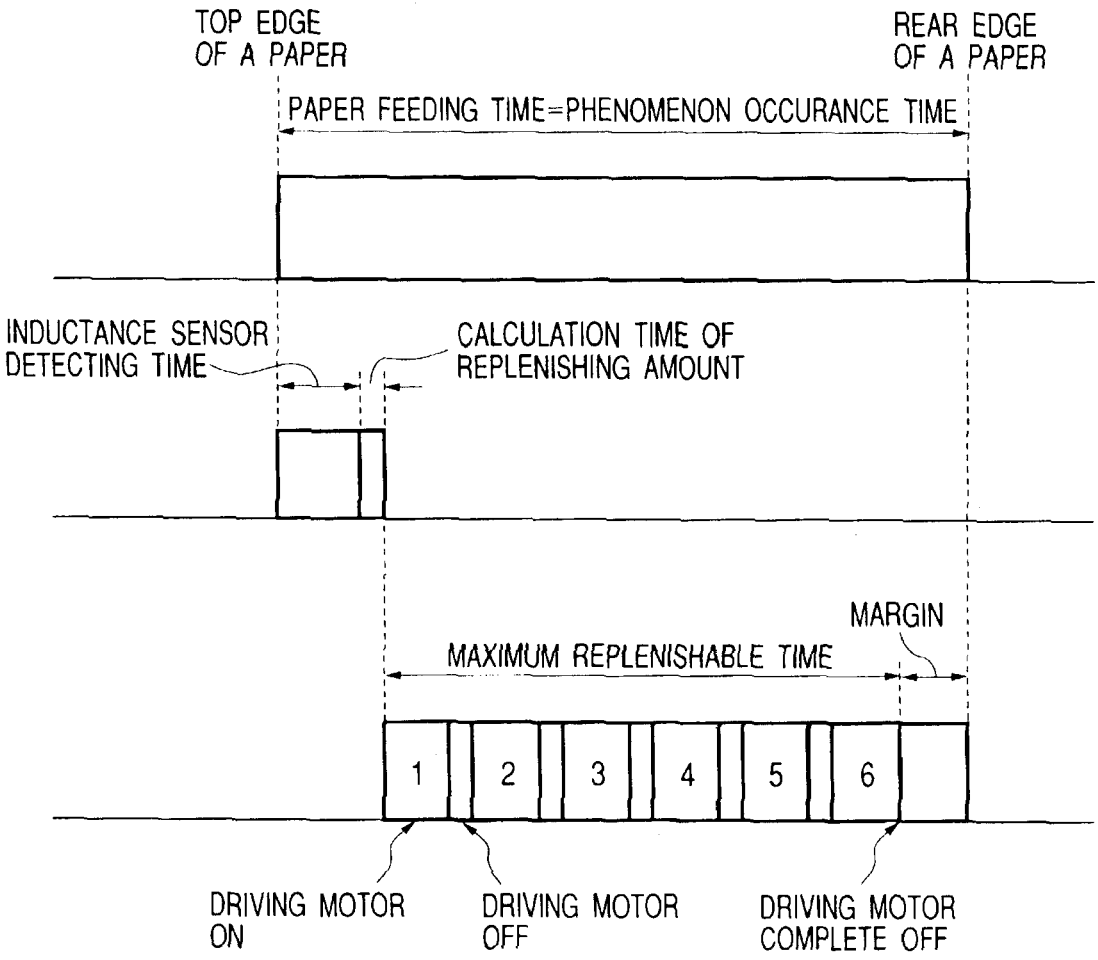
FIG. 13 is a diagram for explaining an ON and OFF control of a driving motor during a replenishing operation.

If a high-density image (such as a solidly filled image) has been output, it is desirable to replenish toner intermittently within a range of maximum replenishable time as shown in FIG. 13, rather than replenish the amount of consumed toner at a time. To be specific, a cycle of toner replenishment is completed while the screw 12*a* is making a turn, and such a cycle of toner replenishment is repeated intermittently.

Here, the operating procedure returns again to the flowchart of FIG. 5.

(Calculation of Total Amount of Toner Consumed)

(8) The following describes calculation processing of the utilization amount of each of the toner replenishing containers 120Y to 120K.

In step S55, a count number ΔX of the amount of toner consumed is calculated. The count number ΔX of the amount of toner consumed in an operation of toner replenishment can be calculated, for example, as ΔX=Driving Amount N'×Correction Coefficient. To be more specific, since two or more kinds of correction coefficients are set, a combination of proper correction coefficients is applied on the basis of a predetermined calculation method.

Then, in step S56, the count number X of the total amount of toner consumed is calculated from the count number ΔX, for example, as X=X+ΔX.

The corrected count number is used for correction, because the discharge amount of toner from the toner replenishing container 120Y-120K always varies depending on the use condition and correction corresponding to each use condition needs performing.

Variations in the amount of toner replenishment are caused by changes in fluidity, density or carrying force of the toner. Although these causes cannot be classified in the strict sense, they can be commonly grouped under the following four headings: (A) Feature of toner, (B) Use Environment, (C) Feature of Toner Discharging Means and (D) Change of Driving force.

(A) The fluidity of toner varies under the influence of the toner manufacturing process, pigments and external additives used. To be more specific, variations in fluidity of toner are caused by differences among nonmagnetic one-component crushed toner, nonmagnetic one-component polymerized toner and magnetic dual-component crushed toner. They also include differences in color.

(B) Use environments put physical stresses on toner. For example, variations in humidity vary the amount of water absorption or electrically charged characteristics of toner. Further, vibrations from physical distribution activities or the like makes bulk density of toner high in early stages of use. Further, if toner has not been replenished for a long time since the user started using the toner, the bulk density of the toner is slightly high.

(C) It is mainly related to differences of feature (arrangement) of the screw 12*a* used. Differences in overall length, inside and outside diameters, screw pitch, tilt angle of the spiral part, surface roughness vary carrying force of toner. Even if respective toner replenishing containers 120Y to 120K have the same shape and size, a large amount of black-and-white printing necessarily increases the amount of replenishing black toner. In this case, the rate of replenishing black toner must be increased compared with other colors of toner. Further, when the apparatus main body is updated, that is, when the processing speed of the apparatus main body is accelerated, the same kind of measure must be taken.

In such a case, the feed amount of the screw 12*a* may be increased or the feature (arrangement) of the screw 12*a* may be changed.

(D) The rotational speed (rpm) of the screw 12*a* varies the carrying force of toner. The carrying force of toner is not always increased in proportion to the rotational speed (rpm), the rise or fall time of the rotation may have an effect in the strict sense. On the other hand, since variations in discharge amount per rotation occur due to differences in time of rotation even at the same rotational speed, the rotating speed (rpm) and the time of rotation of the screw 12*a* need setting carefully.

In the embodiment, variations resulting from the causes (A) to (D) are corrected by using the following correction constants: (a) toner correction constant, (b) humidity correction constant, (c) utilization amount correction constant, (d) driving amount correction constant and (e) part history correction constant.

The above-mentioned correction constants each have two or more tables and are defined in detail. For example, the toner correction constant is divided by color, that is, for yellow, magenta, cyan and black. The humidity correction constant is defined by dividing a certain range of humidity into several sections for which each constant is set.

The utilization amount correction constant is to correct the discharge amount varied from early to latter stages of the life of toner. Specifically, the utilization amount correction constant includes a constant for correcting the discharge amount immediately after the user started using the toner and a constant for correcting a linearly varying inclination of the discharge amount.

The driving amount correction constant is to further correct the above-mentioned linear inclination. To be more specific, although the inclination of the discharge amount of toner/time as shown in FIG. 10 goes down to the right, the inclination of the discharge amount of toner per five times may go up to the right. In other words, differences in terms of a unit of the rotational speed vary the direction of the inclination of the discharge amount of toner/time. Thus the driving amount correction constant correct the inclination of the discharge amount of toner/time according to the driving amount on a unit basis.

The part history correction constant is considered decidable on the basis of the feature (arrangement) of the above-mentioned screw 12*a*. For example, if a reference part and a part to be altered are available, constants are prepared for both the reference part and the part to be altered so that each discharge amount can be corrected on a rotation basis. The part history correction constant may also be set for the shape of the stirring plate or container, rather than the arrangement of the screw 12*a*.

Further, if the toner replenishing container 120Y-120K is a partially or completely recycled part, it may perform in a different way from the way it performed before being recycled. In this case, the part history correction constant may be set for the number of times the part has been recycled.

(Storage Processing of Total Amount of Toner Consumed)

(9) The following describes how to store the amount of consumed toner.

In step S57, the total amount of consumed toner X is temporarily stored in the memory of the apparatus main body 100. Then, after completion of printing operation, the total amount of consumed toner X is stored into the second storage area 403*b* of the radio frequency IC memory unit 400 of each of the toner replenishing containers 120Y to 120K through the communication means as shown in FIG. 1.

Since life information on the toner replenishing containers 120Y to 120K is stored in the radio frequency IC memory unit 400 of each of the toner replenishing containers 120Y to 120K, no problem arises even in the following operational status.

The toner replenishing containers 120Y to 120K in the embodiment can estimate an accurate remaining amount of toner in each of the toner replenishing containers 120Y to 120K by means of the above-mentioned toner remaining amount detecting mechanism, which makes it possible to continuously use such a toner container that it is approaching the end of its life cycle. However, if a large amount of printing must be performed, the toner container may run out of toner and run the danger of stopping the printing job.

In this case, a corresponding one of the toner replenishing containers 120Y to 120K that is approaching the end of its life cycle is detached and replaced with a new container before execution of the job. Then, after the completion of the job, the detached toner replenishing container 120Y-120K that is approaching the end of its life cycle is attached again, until the toner replenishing container 120Y-120K runs out.

Since the life of each of the toner replenishing containers 120Y to 120K is stored in each storage area, the user never dismisses the life information during operations such as replacement of a toner container or the like, which eliminates the need to do extra setting work on the apparatus main body 100.

Thus the present invention can provide a toner replenishing container and an image forming apparatus more useful to users.

Although in the above-mentioned embodiment a color laser printer is used as the electrophotographic image forming apparatus, the present invention is not limited to the embodiment. For example, the present invention is applicable to other types of photographic image forming apparatus such as an electrophotographic copying machine, an LED printer, a facsimile and a word processor. The application of the present invention to other types of image forming apparatus also display the same effects.

Further, the present invention is not limited to the photographic type of image forming apparatus, and it is applicable to other types of apparatus using different recording media such as an ink jet printer using ink as a recording agent.

The following summarizes the above-mentioned characteristics of the present invention:

1) It can determine whether two or more developer replenishing containers are placed in position. If not placed in position, the user can be informed of the error.

2) It can inform the user exactly when the developer replenishing containers need replacing. Further, the operation of the electrophotographic image forming apparatus is stopped as soon as at least one of the developer replenishing containers runs out of developer, thereby preventing the cartridges and the intermediate transfer belt from breaking down.

3) It makes them possible to further reduce the amount of residual toner in each developer replenishing container and replenish toner stably even at the end of its life cycle.

4) It can estimate the utilization amount more accurately than that in the conventional, which makes it possible to inform the user exactly when the developer replenishing containers need replacing.

It should be noted that the present invention may be applied to a system composed of two or more pieces of equipment (such as a host computer, an interface unit, a reader and a printer), or a piece of equipment (such as a small image processing unit like a PDA (Personal Digital Assistant), a copying machine or a facsimile).

The present invention is, of course, applicable to a case where the system or apparatus is implemented by a program. The present invention can also be realized by supplying to the system or apparatus a recording medium with a software-described program stored thereon, whereby the user can read out program codes stored on the recording medium to execute the program on a computer (or CPU or MPU) incorporated in the system or apparatus.

In this case, since the program codes themselves read out from the recording medium realize the features as described in the above-mentioned embodiment, the recording medium with the program codes stored thereon also embodies the present invention.

The recording medium for supplying the program codes may be a floppy disk, a hard disk, an optical disk, magneto-optical disk, a CD-ROM, a CD-R, a magnetic tape, a nonvolatile memory card (IC memory card), a ROM (such as a mask ROM or flash EEPROM) and so on.

Although the features of the above-mentioned embodiment are realized by reading out and executing the above-mentioned program codes on the computer, a software platform such as an OS (Operating System) running on the computer can also execute part or all of actual processing in accordance with instructions from the program codes, which also makes it possible to realize the features of the above-mentioned embodiment.

Further, the program codes read out from the recording medium can be written in a memory provided in an extension unit connected to the computer or an extended board inserted in the computer, so that a CPU provided in the extended board or the extension unit executes part or all of actual processing on the basis of the program codes, thereby realizing the features of the above-mentioned embodiment.

While the described embodiment represents the preferred form of the present invention, it is to be understood that modifications will occur to those skilled in the art without departing from the spirit of the invention. The scope of the invention is therefore to be determined solely by the appended claims.

What is claimed is:

1. A cartridge being detachably mountable to a main body of an image forming apparatus, the image forming apparatus including a photosensitive member, charging means for charging the photosensitive member, developing means for developing a latent image formed on the photosensitive member, and a developer container, said cartridge comprising:

a developer replenishment container for containing powder to develop the latent image formed on the photosensitive member;

a supply member for supplying the powder from said developer replenishment container to the developer container; and a memory device including:

a first memory portion for storing threshold information to change a driving amount of said supply member in an action in which said supply member supplies a powder; and a second memory portion for storing information relating to a total driving amount of said supply member.

2. A cartridge according to claim 1, wherein the threshold information corresponds to a value relating to a remaining amount of the powder in said developer replenishment container, and wherein the information relating to the total driving amount of said supply member corresponds to a value relating to a total utilization amount of the powder supplied from said developer replenishment container.

3. A cartridge according to claim 1, wherein the powder includes a toner.

4. A cartridge according to claim 1, wherein the powder includes a toner and a carrier.

5. A memory device for use with a cartridge detachably mountable to a main body of an image forming apparatus, the image forming apparatus including a photosensitive member, charging means for charging the photosensitive member, developing means for developing a latent image formed on the photosensitive member, a developer container, a developer replenishment container for containing powder to develop the latent image formed on the photosensitive member, and a supply member for supplying the powder from the developer replenishment container to the powder container;

said memory device comprising:

a first memory portion for storing threshold information to change a driving amount of said supply member in an action in which the supply member supplies the powder; and a second memory portion for storing information relating to a total driving amount of the supply member.

6. A memory device according to claim 5, wherein the storing information relating to the total driving amount of the supply member corresponds to a value relating to a total utilization amount of the powder supplied from the developer replenishment container.

7. A memory device according to claim 5, wherein the cartridge includes the developer replenishment container and the supply member.

8. A memory device according to claim 5, wherein the powder includes a toner.

9. A memory device according to claim 5, wherein the powder includes a toner and a carrier.

10. A control system for controlling an image forming apparatus, the image forming apparatus including a cartridge detachably mounted to a main body of the image forming apparatus, a photosensitive member, charging means for charging the photosensitive member, developing means for developing a latent image on the photosensitive member, a developer container, detecting means for detecting a density of a developer in the developer container, a developer replenishment container for containing powder to develop the latent image on the photosensitive member, and a supply member for supplying the powder from the developer replenishment container to the developer container, detecting means for detecting a density of the powder in the developer container, said control system comprising:

a memory device mounted on the cartridge, including:

a first memory portion for storing threshold information to change a driving amount of the supply member in an action in which the supply member supplies the powder; and a second memory portion for storing information relating to a total driving amount of the supply member; and controlling means for varying the driving amount of the supply member based on a detection result of the detecting means and the threshold information and the information relating to the total driving amount of the supply member.

11. A control system according to claim 10, wherein said controlling means varies the driving amount of the supply member, if a value corresponding to the information relating to the total driving amount of the supplying member is greater than a value corresponding to the threshold information.

12. A control system according to claim 10, wherein the information relating to the total driving amount of the supply member corresponds to a value relating to a total utilization amount of the developer supplied from the developer replenishing container.

13. A control system according to claim 10, wherein the cartridge includes the developer replenishment container and the supply member.

14. A control system according to claim 10, wherein said controlling means varies the driving amount of the supply member based on the threshold information and the information relating to the total driving amount of the supply member, if the detection result is lower than a reference value.

15. A control system according to claim 10, wherein the powder includes a toner.

16. A control system according to claim 10, wherein the powder includes a toner and a carrier.

* * * * *